US005635690A

United States Patent [19]

Knecht et al.

[11] Patent Number: 5,635,690

[45] Date of Patent: Jun. 3, 1997

[54] ELECTRICAL SWITCH WITH CONNECTOR INTERLOCK

[75] Inventors: George W. Knecht, New Port Richey; Donald D. Busby, Tampa, both of Fla.

[73] Assignee: Thomas & Betts Corporation, Memphis, Tenn.

[21] Appl. No.: 435,588

[22] Filed: May 5, 1995

[51] Int. Cl.[6] ..... H01H 9/20

[52] U.S. Cl. ..... 200/51.09; 200/50.3

[58] Field of Search ..... 200/50.28, 50.3, 200/50.31, 51.09, 332.1

[56] References Cited

U.S. PATENT DOCUMENTS

| | | | |
|---|---|---|---|
| 1,971,990 | 8/1934 | Reynolds et al. | 200/50.28 |
| 2,420,865 | 5/1947 | Conlan | 200/50.31 |
| 3,598,941 | 8/1971 | Nelson | 200/51.09 |
| 4,335,286 | 6/1982 | Nelson | 200/302 |
| 4,414,440 | 11/1983 | Decoste | 200/50.31 |
| 4,521,649 | 6/1985 | Nelson | 200/50.28 |
| 4,604,505 | 8/1986 | Henninger | 200/50 |

*Primary Examiner*—Renee S. Luebke

*Attorney, Agent, or Firm*—C. Douglas McDonald, Jr. & Associates; Michael L. Hoelter

[57] ABSTRACT

An electrical switch and connector interlock mechanism permits ready reception and removal of a connector portion on a power cable from a connector portion attached to the unit and prevents current flow when the two connector portions are unseated or when a line connector is not received within the unit.

24 Claims, 19 Drawing Sheets

ELECTRICAL SWITCH WITH CONNECTOR INTERLOCK

FIELD OF THE INVENTION

This invention relates to mechanical interlocking mechanisms for use with electrical power receptacles or inlets with apparatus both to prevent such receptacles or inlets from remaining electrically live when they are connected to or disconnected from electrical plugs or connectors and also to prevent such receptacles or inlets from being electrically live at any time that an electrical plug or connector is not present within that receptacle or inlet.

BACKGROUND OF THE INVENTION

Various types of electrical outlet receptacles have been provided for use in marine, commercial and industrial applications with an included interlocking mechanism to reduce the hazards of inserting into or withdrawing from such a receptacle a plug while the receptacle is in a live condition. A common application of this type of outlet receptacle involves refrigerated containers that are transported on land by trucks and on sea by ships. When these vehicles are transported on land, electrical power to drive the refrigeration system is provided by the transporter, such as the tractor pulling the container. When these containers are delivered for loading onto ships, the electrical plugs for powering the refrigeration unit must be plugged into a shore-side power source, and when on board a ship, they must be plugged into a source of electrical power on the ship. When the refrigerated container is at dockside or on board the ship, the source of the electrical power should be sealed water-tight to protect against the wet environment and potential problems of corrosion and rust from salt water and salt air. Additionally, because the current is typically 220 volts or 440 volts with substantial amperage, it is important that the receptacle be provided with apparatus that prevents inserting or withdrawing a plug while the circuit is live, and which apparatus also switches off power to the receptacle when a plug is not present. While various means, most commonly involving o-ring seals, have been widely used to effect waterproof sealing of such units, problems have remained with respect to the interlocking mechanisms for ensuring that a plug cannot be disconnected while the circuit is live and for ensuring that no electrical power is provided to the receptacle outlet when a plug is removed.

Various types of interlocking mechanisms have been used in the past. These have included what is known as the "full interlock" in which a plug must be inserted into the unit, with a switch then being actuated to turn the unit on. An interlock mechanism is provided to prevent the switch from being turned on without a plug in place, and that mechanism also serves to lock the plug in place while the unit is on. The interlock latch must be affirmatively released, cutting the power to the outlet, before the plug can be removed. A problem with this type of structure has occurred when the refrigerated container has been removed, either by a truck or by a crane, without the electrical cable plug of that container having been removed from the power outlet. Because the plug is latched in place, such removal of the container rips the cable either out of the refrigeration unit or out of the plug, causing damage and a dangerously live plug. A second type of interlock is referred to as the "partial interlock" in which an inserted plug is locked in place by a latch whenever the unit is turned on, but which unit may be turned on without a plug inserted. Because the outlet receptacle may be enclosed within a housing in which it is desirable to supply power is also supplied to other outlets within that housing, this arrangement is desirable for certain purposes but remains potentially dangerous in providing a powered receptacle that has no plug in it. A third type of interlock is known as the "spring off" interlock in which a plug must be inserted in order to permit an operating handle to turn the unit on. If a plug is withdrawn without the unit being turned off, a spring will trip the unit to the off, or unpowered, state as the plug is withdrawn. However, if the operating handle is held in the "on" position as the plug is removed, arcing and shock hazard may occur, and that receptacle may be left in a live, powered state, with the attendant danger. Accordingly, it is possible for the "spring off" type of devices to be left in a dangerous, live condition by inadvertent improper use thereof.

SUMMARY OF THE INVENTION

It is an object of the present invention to provide an electrical switch or circuit breaker with an interlocking mechanism that avoids placing or maintaining an outlet receptacle in a make or break live condition through inadvertent removal of a plug or inadvertent operation of a handle or member intended to provide power to the receptacle outlet. It is a further object of this invention to provide such structure that is straightforward and reliable and very difficult for an operator to defeat. These and other objects of the invention are provided by an electrical switch including a housing, a switch unit mounted within the housing and adapted to be connected to a source of power, a first connector portion mounted to the housing and adapted to receive a second connector portion mounted to an electrical cable and providing an electrical connection between the switch unit and the first connector portion, a switch unit operating member mounted to the housing for movement between a first position and a second position and including a handle for enabling a human operator to move the operating member, an actuating member mounted for movement corresponding to movement of the operating member between the first position and the second position and being operatively connected to the switch unit for moving a portion of that switch unit between a first, open circuit state when the actuating member is in the first position and a second, circuit completing state when the actuating member is in the second position, this actuating member being resiliently biased toward said first position and further comprising structure for selectively engaging the operating member for movement therewith, a connector portion engaging member mounted to the first connector portion for reciprocal movement in a predetermined direction by reception of said second connector portion by the first connector portion, such connector portion engaging member being operatively connected to the actuating member for effecting the selective engagement between the operating member and the actuating member when the connector portion engaging member is moved in that predetermined direction and for releasing the selective engagement when the connector portion engaging member is moved in a direction opposite that predetermined direction, and resilient biasing means urging the connector portion engaging member to move in the opposite direction upon removal of the second connector portion from the first connector portion.

BRIEF DESCRIPTION OF THE DRAWINGS

Preferred embodiments of the present invention are illustrated below in connection with the drawings in which.

DESCRIPTION OF PREFERRED EMBODIMENTS

Two principal preferred embodiments of the apparatus of this invention, along with other modifications, are illustrated in the figures, with FIGS. 1–10 illustrating one principal embodiment and FIGS. 20–29 illustrating a second principal embodiment, both being within the scope of the invention.

Figure 1:
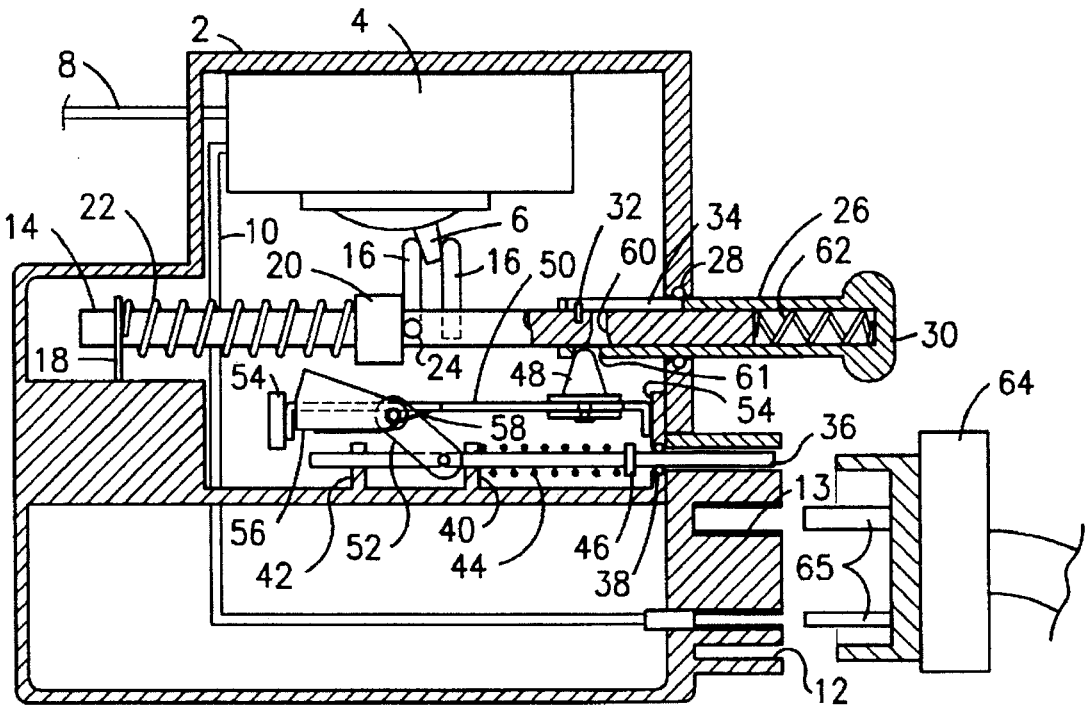
FIG. 1 is a side sectional view of a first preferred embodiment of the switch and interlock mechanism of this invention in which no plug is present and the circuit breaker is in the "off" position.
Figure 33:
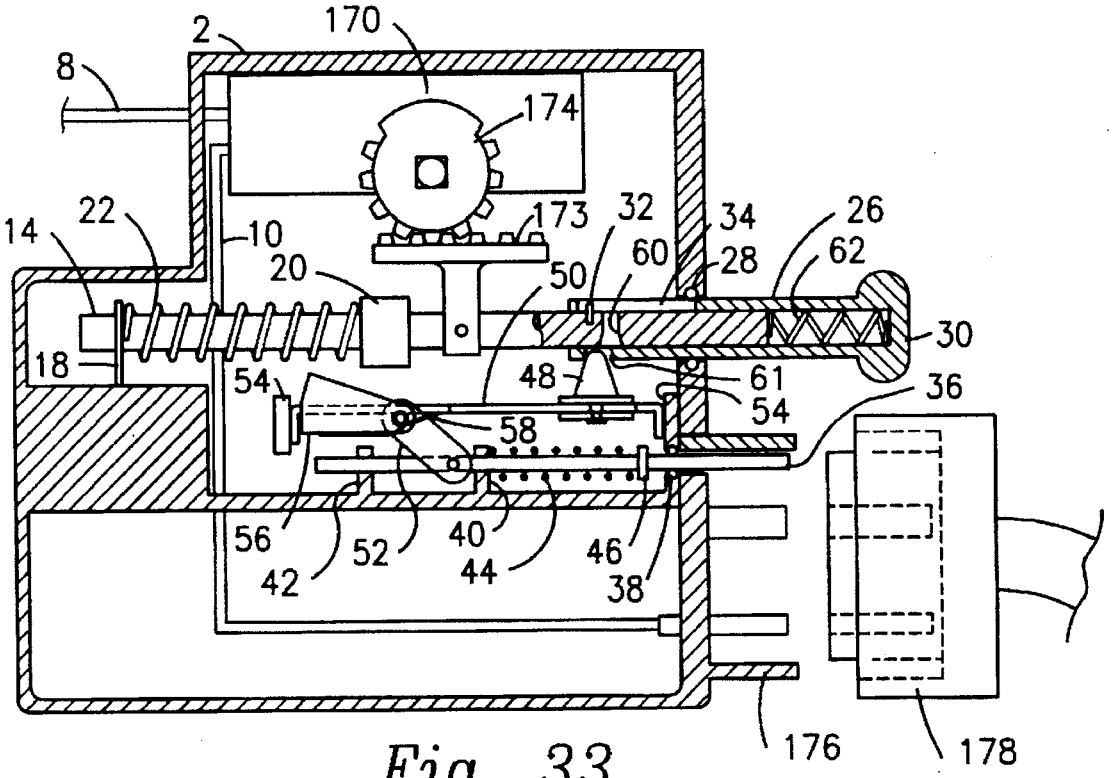
FIG. 33 represents apparatus similar to that of FIG. 1 but with a rotary switch replacing the circuit breaker and an inlet and connector arrangement replacing the receptacle and plug apparatus of FIG. 1.
Figure 34:
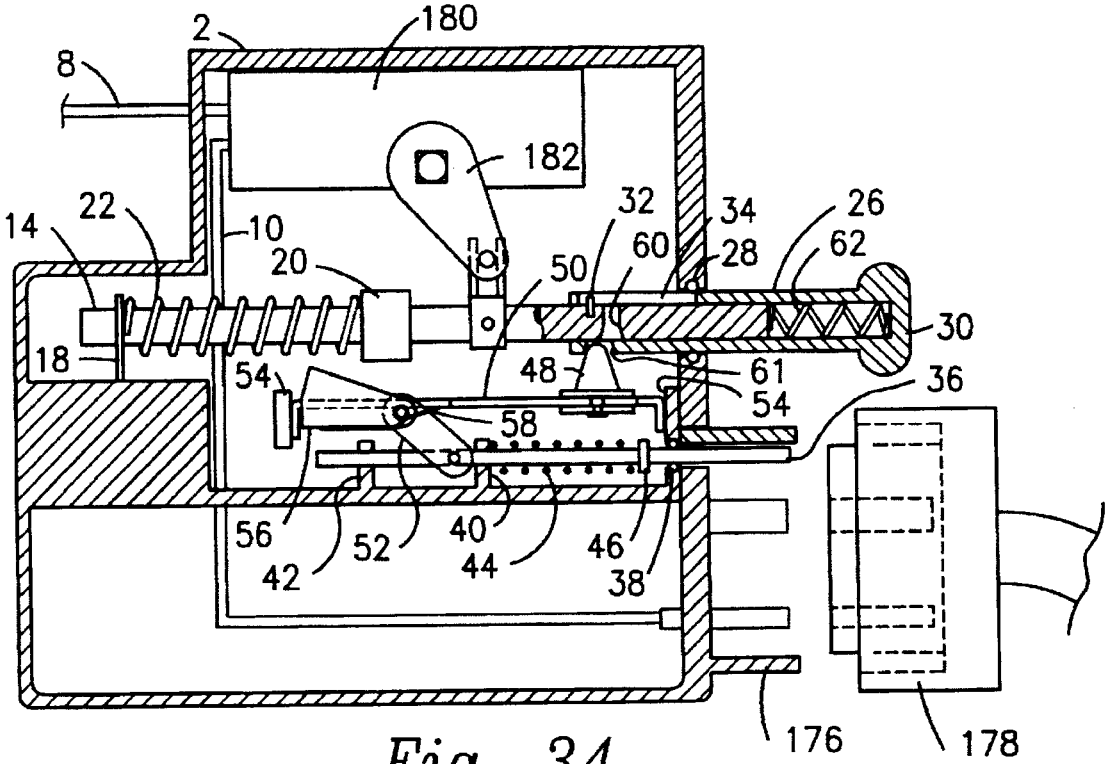
FIG. 34 illustrates apparatus similar to that of FIG. 33 but utilizing a different type of rotary switch.

In FIG. 1 is illustrated a side sectional view of the electrical switch and interlock apparatus of a first embodiment of this invention, including a housing 2, which may be fabricated of any appropriate metal or synthetic resin, and to which is mounted at least one switch unit, which may conveniently be a circuit breaker 4 of conventional construction and may comprise a single or multipole device in which the switch handle 6 may be moved between a first position, illustrated in FIG. 1, in which the circuit within the breaker is open, and a second position (illustrated in FIG. 4) in which the switch handle is moved to a second, circuiting completing position, with a conventional intermediate tripped position and a conventional reset position. While the embodiments of FIGS. 1 through 29 are illustrated with a circuit breaker 4 as the switch unit, it is to be understood that the switch unit could likewise comprise a conventional on-off switch without the protective features of a circuit breaker. Illustrated examples of those structures are shown in FIGS. 33 and 34. This circuit breaker 4 conventionally includes an input power cable 8 connected through the circuit breaker to an output cable 10, which is connected to a first connector portion, conveniently a plug receptacle 12, mounted to the housing 2. This receptacle includes electrical connecting means such as conventional metal contacts 13, and may be of any convenient configuration for receiving any of a variety of common and well-known power plugs, such as are used on refrigerated containers, and of which the Mipco plug is one common example. In the illustration of FIG. 1 there is no plug inserted into the receptacle 12. While the embodiments of FIGS. 1 through 29 are shown with a receptacle mounted to the housing and a plug attached to the end of a power cable, it is to be understood that the first connector portion could equally well be a male-type inlet mounted to the housing, for reception of a female connector portion, as illustrated in FIGS. 33 and 34.

Mounted within the housing 2 is the switch unit or circuit breaker actuating member 14, which conveniently is in the form of an elongated shaft, suitably of circular cross section. This actuating member 14 is mounted within the housing for reciprocating movement (to the left and the right as shown) between the first position illustrated in FIG. 1 and a second position illustrated in FIG. 4. Mounted to the actuating member 14 are circuit breaker switch actuating fingers 16, which may conveniently be metal rods, that capture the circuit breaker switch handle 6 between them for actuation. One end of the actuating member 14 is slidably received through a mount 18, which may be of conventional configuration such as a bushing.

The actuating member 14 carries on it a latching element 20, suitably in the form of a ring slidably received over the actuating member. The latching element 20 is resiliently biased by a suitable structure, such as a coil spring 22 or other known equivalent, with one end of that resilient biasing structure 22 being receiving against the support 18 and the other bearing against the latching element 20. Movement of the latching element 20 to the right in FIG. 1 is restrained by conventional means, such as a pin 24 inserted through the actuating member 14. With this arrangement the resilient biasing member 22 urges the latching element 20 and the pin 24 to the right in FIG. 1, thus urging the circuit breaker engaging member 16 to the position shown in FIG. 1 with the circuit breaker 4 in the "off" or first, open circuit position. Thus, the pin 24 and the resilient biasing means 22 function as limiting elements to the movement of the latching element 20 on actuating member 14.

Figure 2:
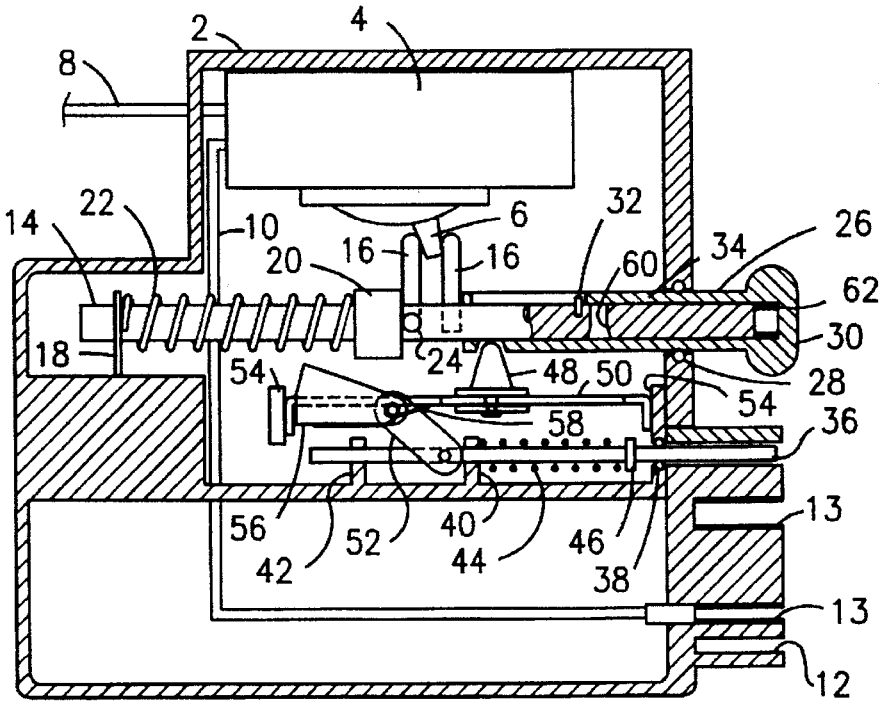
FIG. 2 illustrates the apparatus of FIG. 1 when a reset is attempted without a plug present in the receptacle.
Figure 3:
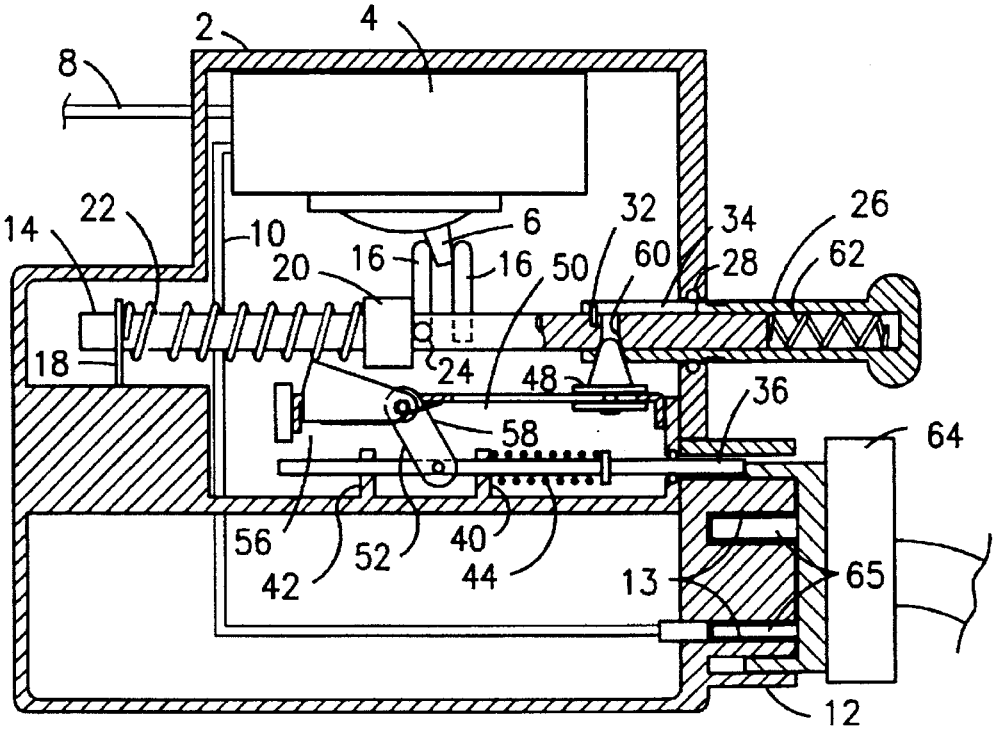
FIG. 3 illustrates the apparatus of FIG. 1 in which a plug is inserted into the receptacle, with the circuit breaker in the "off" position and ready to be reset.
Figure 4:
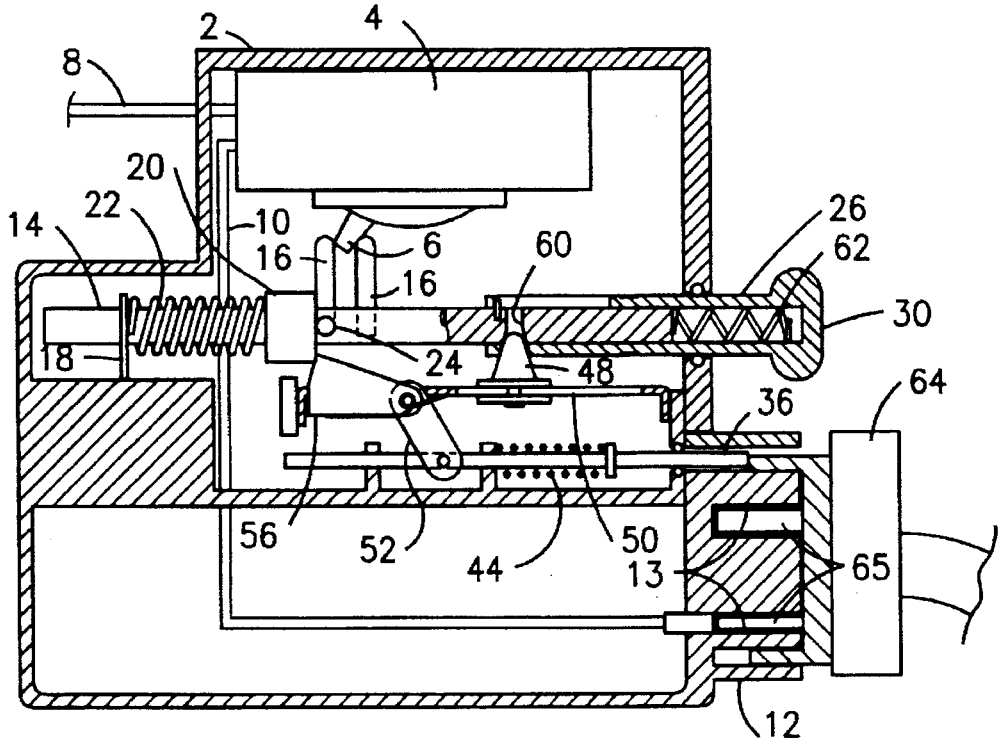
FIG. 4 illustrates the apparatus of FIG. 1 in which a plug is inserted into the receptacle and the circuit breaker is moved to the "on" position.

Also mounted to said housing is a circuit breaker, or switch unit, operating member 26 which, in this embodiment, may be in the form of a tubular member received over the right hand end (in FIG. 1) of the actuating member 14 and extending through an aperture in the side of the housing 2. Suitable means, such as a resilient o-ring 28, provide a waterproof seal around that aperture and the operating member 26. This operating member 26 is selectively movable between a first position, such as shown in FIGS. 1 and 3, and a second position, moved to the left in these illustrations, as shown in FIGS. 2 and 4. This actuating member is provided with a handle 30 to enable a human operator to move the operating member 26 between such first and second positions. Preferably, the amount of movement of the operating member 26 relative to the actuating member 14 is limited by a suitable and conventional structure, such as pin 32 received into actuating member 14 and riding within a slot 34 in the side of operating member 26.

Mounted within the plug receptacle 12 is a plug, or connector portion, engaging member 36, suitably in the form of a rod or similar structure. This plug engaging member 36 is mounted for reciprocal movement in a predetermined direction, to the left in FIG. 1, when a plug is inserted (as in FIG. 3). Where the plug engaging member 36 passes through the wall of the housing 2 there are provided suitable waterproof seals, such as an o-ring 38. Within the housing 2 this plug engaging member 36 may suitably be received for sliding movement by supports 40 and 42, with a second resilient biasing means, such as a coil spring 44, or other conventional structure, suitably extending between support 40 and retaining member 46 to urge this plug engaging member to the right when any plug that engages it is removed from the receptacle.

Mounted within the housing 2 is also a connecting member 48 that is selectively movable between one position in which it engages both the operating member 26 and the actuating member 14 to facilitate corresponding movement of both the actuating member 14 and the operating member 26, and another position out of engagement with at least one of the pair of the actuating member 14 and the operating member 26. This connecting member 48 is illustrated in FIG. 1 in the second position out of engagement with the actuating member 14. In FIGS. 3 and 4 it is illustrated in the other position engaging both the operating member 26 and the actuating member 14.

This connecting member 48 is carried by a suitable support for selectively moving it into connecting engagement with both operating member 26 and actuating member 14 and out of engagement with at least one of those members. In the embodiment of FIGS. 1 through 5 the apparatus for selectively moving this connecting member 48 into and out of connecting engagement with the operating member 26 and actuating member 14 is illustrated as that structure positioned below those two members. This structure includes the support 50 to which the connecting member 48 is slidably mounted for sliding movement between a position to the right illustrated in FIGS. 1, 3 and 5 and another position moved to the left, as illustrated in FIGS. 2 and 4. This support member 50 is pivotally mounted to one end of a toggle linkage 52, the opposite end of which linkage is pivotally connected to the plug engaging member 36. The support member 50 is slidably supported at each end by guide members 54, permitting sliding movement of that support 50 toward and away from the actuating member 14. Also pivotally mounted to the support 50 is a latching member 56, which may conveniently be mounted to the same pivot axis as attaches the upper portion of a toggle linkage to the support 50. Suitable means, such as the coil spring 58 or the like, bias the latching member 56 toward the actuating member 14 for purposes to be described below.

As shown in FIG. 2, when there is no plug inserted into the receptacle 12, so that the plug engaging member 36 is urged to the right in these illustrations by the biasing means 44, the support 50 is maintained in the position illustrated, such that the connecting member 48 remains out of engagement with the recess or aperture 60 in the actuating member, although it may remain captured within the aperture 61 of the operating member 26. Thus, if a user attempts to reset the circuit breaker, moving it from its first, open circuit position to a second, circuit completing position, there will be no connecting engagement between the operating member 26 and the actuating member 14. Accordingly, all that will occur is compression of the spring 62 that extends between the actuating member 14 and the operating member 26, as shown in FIG. 2, with the circuit breaker remaining in the open circuit position.

A second connector portion, such as plug 64, includes electrical connecting means such as conventional metal contacts 65, and may conveniently but not necessarily be a Mipco plug, connecting a power cable to the power supply controlled by the apparatus of this invention. This second connector portion, or plug 64, may be received by the first connector portion, or receptacle 12 as shown in FIG. 3, moving the plug or connector portion engaging member 36 to the left, thus moving the lower pivot of the toggle linkage 52 likewise to the left and thereby moving upwardly the support 50 carrying the connecting member 48. The connector portion engaging member 36 is dimensioned such that the connecting member 48 is not moved into a position to engage both the operating member and the actuating member until the electrical connecting means 13 and 15 within the first and second connector portions are engaged to complete an electrical connection, so that the receptacle cannot be live at the time that the plug is inserted. With the operating member 26 and handle 30 urged to the right under the influence of spring 62, the connecting member 48 is thereby ready to be moved into connecting engagement between the operating member 26 and the actuating member 14. In this configuration the actuating member 14 and the operating member 26 are thus connected together for corresponding movement with one another, which, in this embodiment, will thus be coaxial movement of the two members. In this configuration the circuit breaker remains off but is ready to be reset. As noted above, this embodiment is illustrated with the first connector portion comprising a plug receptacle 12 and the second connector portion comprising a conventional plug 64. However, this invention may be used with equal facility with the first connector portion comprising a conventional power inlet in place of the receptacle 12 and the second connector portion comprising a conventional connector in place of the plug 64, if desired.

In FIG. 4 is illustrated the result of a human operator resetting or turning on the circuit breaker of this apparatus by pushing the handle 30 of the operating member 26 inwardly of the housing, to the left in these illustrations, at a time when a plug 64 is received within the receptacle 12. Because the operating member 26 and actuating member 14 are operatively connected together by their mutual engagement with connecting member 48, the actuating member 14 and its circuit breaker actuating fingers 16 are moved to the left, thus moving the switch handle 6 to a second, circuit completing state, to the left in FIG. 4. This movement of the actuating member 14, and thus of pin 24, also moves the latching element 20 in the same direction, compressing the first biasing means or compression spring 22 as shown in FIG. 4. This movement of the latching element 20 also moves it past the resiliently biased latching member 56, with the biasing spring 58 then urging that latching member upwardly to engage and latch the latching element 20, as shown in FIG. 4. As long as this latching engagement remains between the latching member 56 and the latching element 20, the spring 22 will not move the actuating member 14 back to the right, to shift the circuit breaker back to the open circuit position, but will maintain it in the position shown in FIG. 4 until either the plug 64 is removed or the operator affirmatively pulls the handle 30 of the operating member 26 outwardly of the unit.

Figure 5:
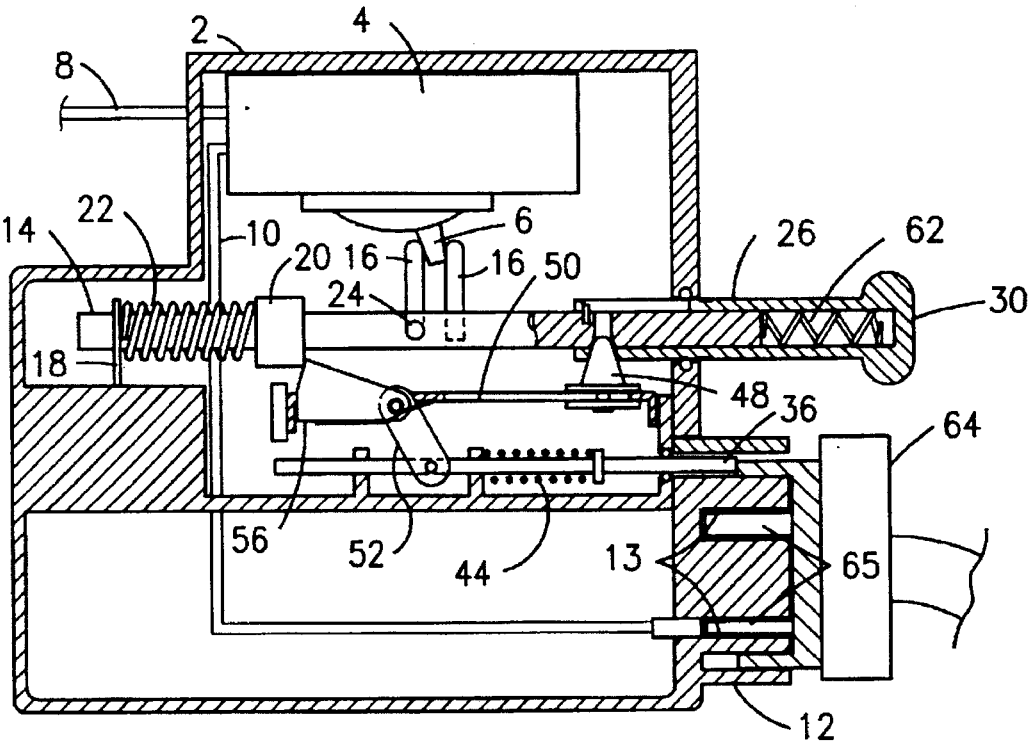
FIG. 5 illustrates the apparatus of FIG. 1 with a plug inserted into the receptacle and the circuit breaker manually moved to the "off" position.

If, after a plug 64 has been inserted into this apparatus and the circuit breaker 4 has been turned on, the operator desires to turn off the power without removing the plug 64, he may do so by simply pulling the handle 30 on the operating member 26 outwardly of the unit, as shown in FIG. 5. The operative connection between the operating member 26 and the actuating member 14 effected by the engagement of those two members with the connecting member 48 will thus move the actuating member 14 to the right, causing the actuating finger 16 to move the switch handle 6 back to the first, open circuit position, as shown in FIG. 5. So long as the plug 64 remains inserted, the operator can again turn on the power by again pushing in on the handle 30 to move the apparatus back to the configuration illustrated in FIG. 4.

If the plug 64 were to be removed without first turning off the power by pulling the handle 30 outwardly of the unit, as shown in FIG. 5, the result would be exactly as shown in FIG. 1. Removal of the plug 64 would allow the spring 44 of the second resilient biasing means, acting against the retaining means 46, to move that plug engaging member 36 back to the right, as shown in FIG. 1. This movement of the plug engaging member 36 would cause the toggle member to return to the position shown in FIG. 1, both withdrawing the connecting member 48 from its connecting engagement with the actuating member 14 and also withdrawing the latching member 56 from its engagement with the latching element, such as the ring 20. In this situation the spring 22, which comprises the first biasing means acting against the latching element 20, which in turn bears against the pin 24, will move the actuating member 14 back to the right, to the configuration illustrated in FIG. 1. The spring 62 would also urge the operating member 26 and its handle 30 outwardly of the unit. These events, which will occur before disengagement between the electrical connecting means within the first and second connector portions, will thus cut the power flow through the switch unit, so that the receptacle will not be live at the time that the plug 64 is withdrawn from electrical connection with that receptacle 12. Thus, the second connector portion cannot be removed from electrical connection with the first connector portion with the switch unit in a circuit completing state.

FIGS. 6 through 10 illustrate substantially the same apparatus but utilizing an arcuately pivoting handle instead of the linear push-pull handle of FIGS. 1 through 5 for operation of this unit. But for this different form of operating handle, FIGS. 6 through 10 correspond directly to the structure and conditions of FIGS. 1 through 5, respectively.

Figure 6:
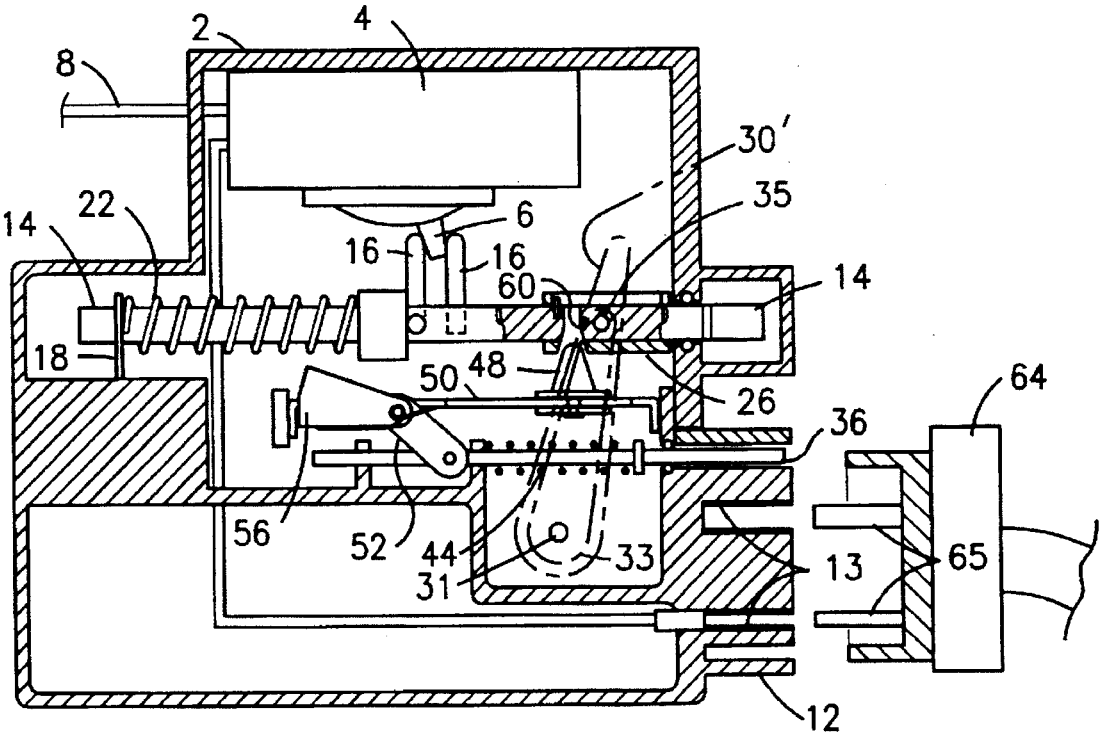
FIGS. 6–10 illustrate a variation on the apparatus of FIGS. 1–5 in which the plunger-type operating handle of FIGS. 1–5 is replaced with a pivoting, lever-type handle.
Figure 7:
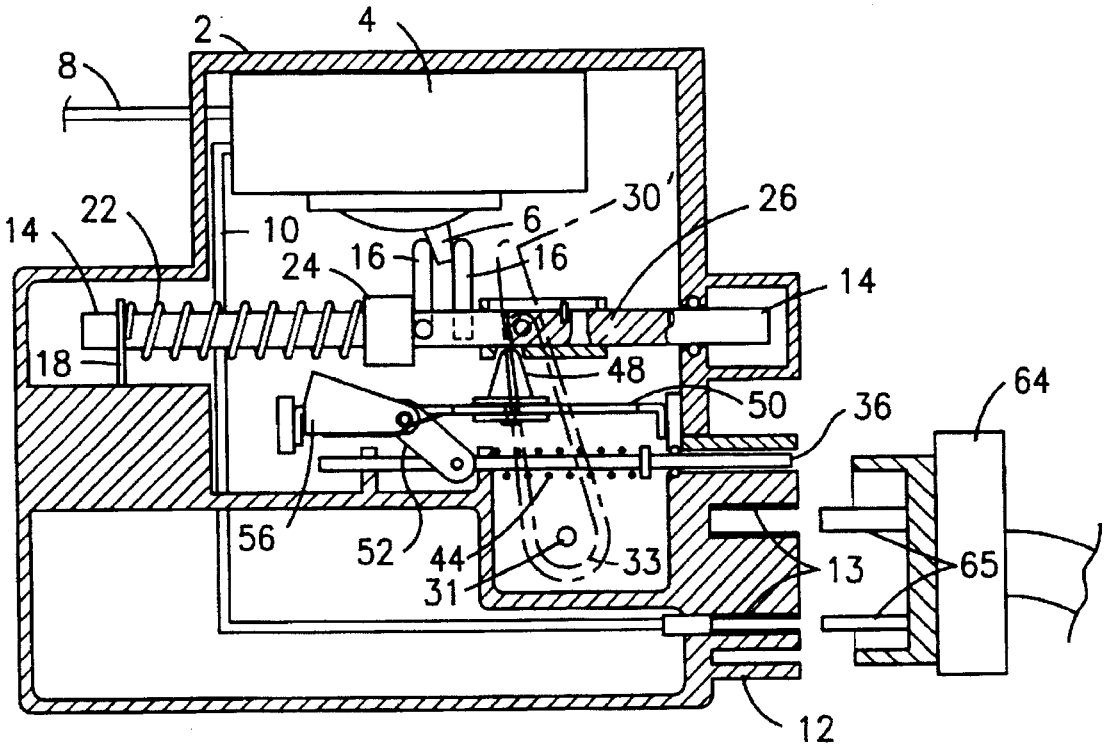
Figure 8:
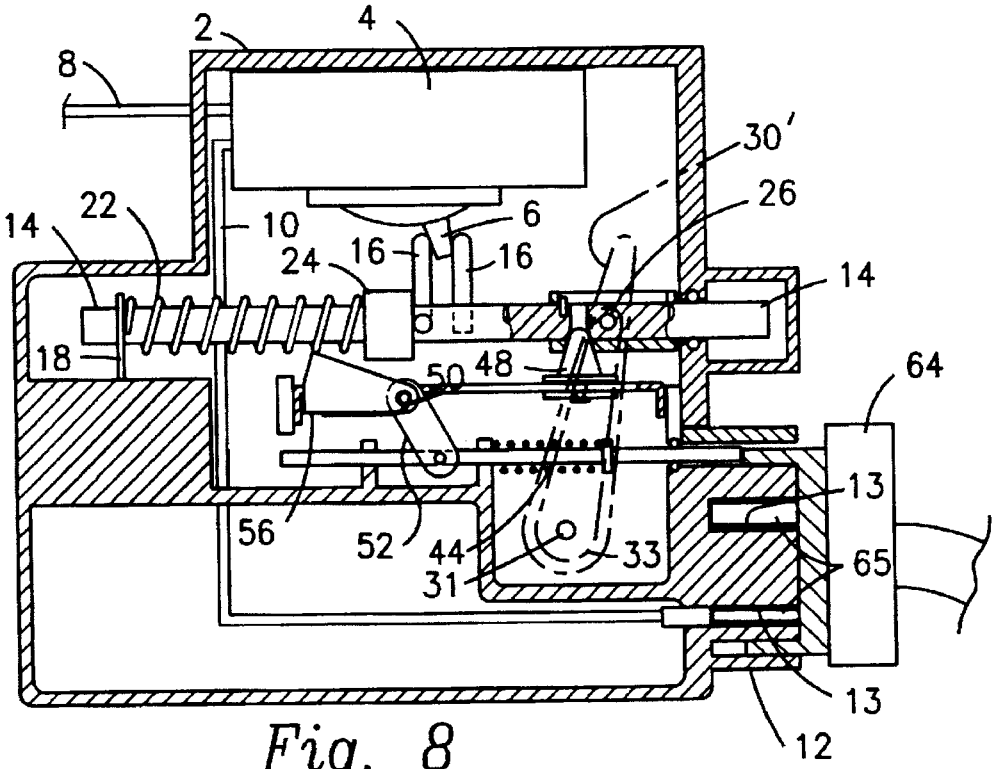
Figure 9:
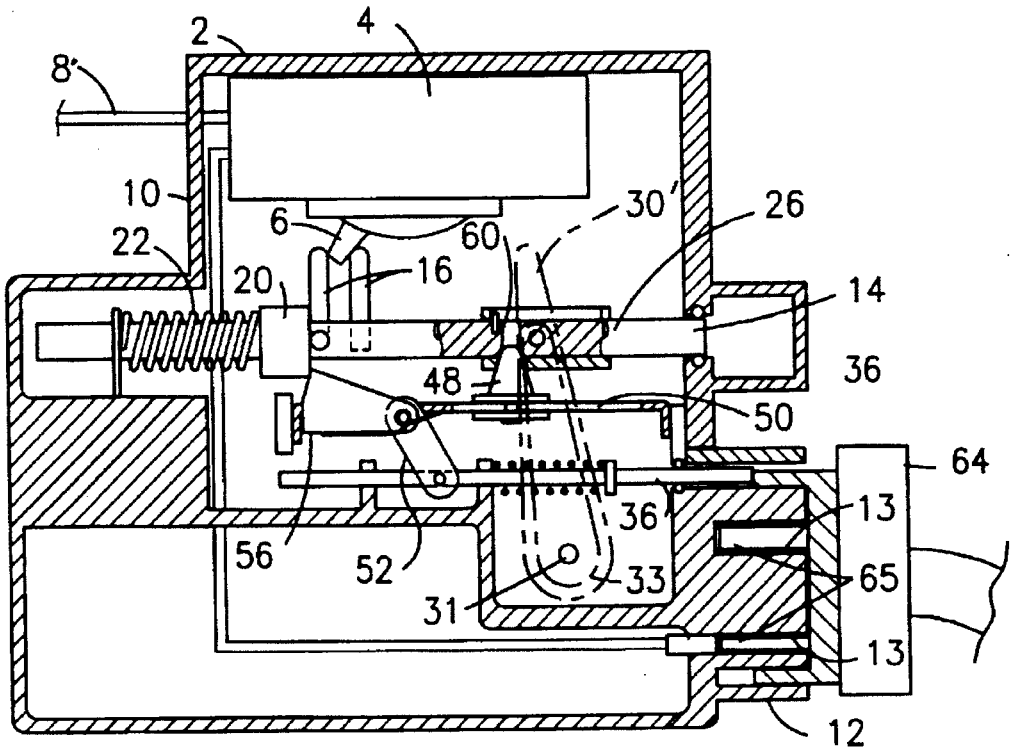
Figure 10:
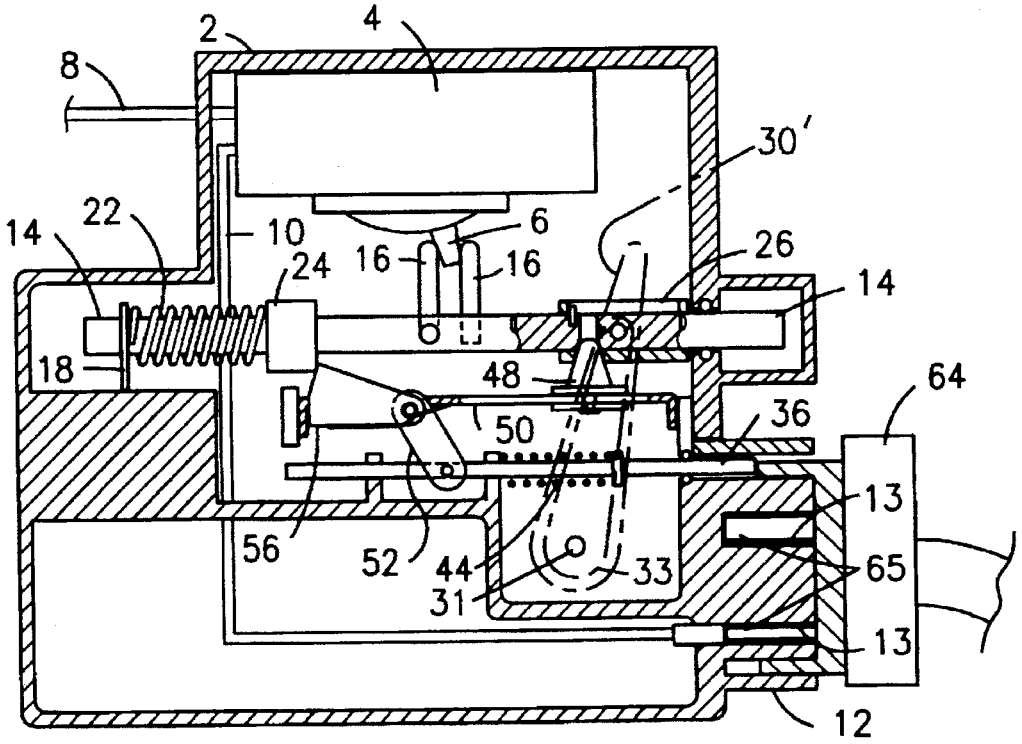

In these embodiments the actuating handle 30' is shown in phantom and is pivotally mounted to the housing by an appropriate shaft 31 for arcuate movement between the positions illustrated in FIGS. 6, 8 and 10 and those illustrated in FIGS. 7 and 9. This actuating handle 30' comprises an external member, with a corresponding internal arm 33 connected at one end to that same shaft 31 and at its opposite end to a pivotal connection 35 joining it to the operating member 26, suitably in the form of a sleeve extending over the actuating member 14. Movement of the operating member 26 is thus controlled by the arcuate pivoting of the handle 30', thus effecting substantially the same axial movement of the operating member 26 as was accomplished by the push-pull or plunger type handle 30 of the embodiment of FIGS. 1 through 5. Because the remaining structure and operation of this pivot handle variation is substantially identical to that of the embodiment of FIGS. 1 through 5, it will not be discussed in further detail.

Figure 11:
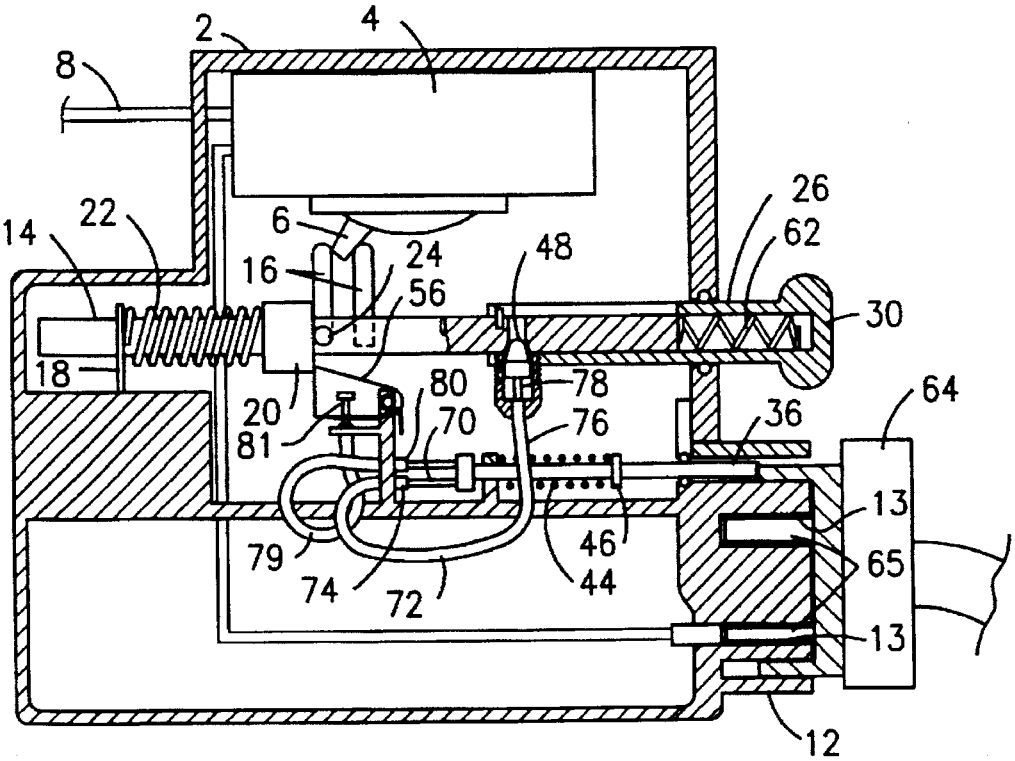
FIGS. 11 and 12 illustrate the apparatus of FIGS. 4 and 9 in which the toggle linkage mechanism for moving the connecting member is replaced with a flexible cable mechanism.
Figure 12:
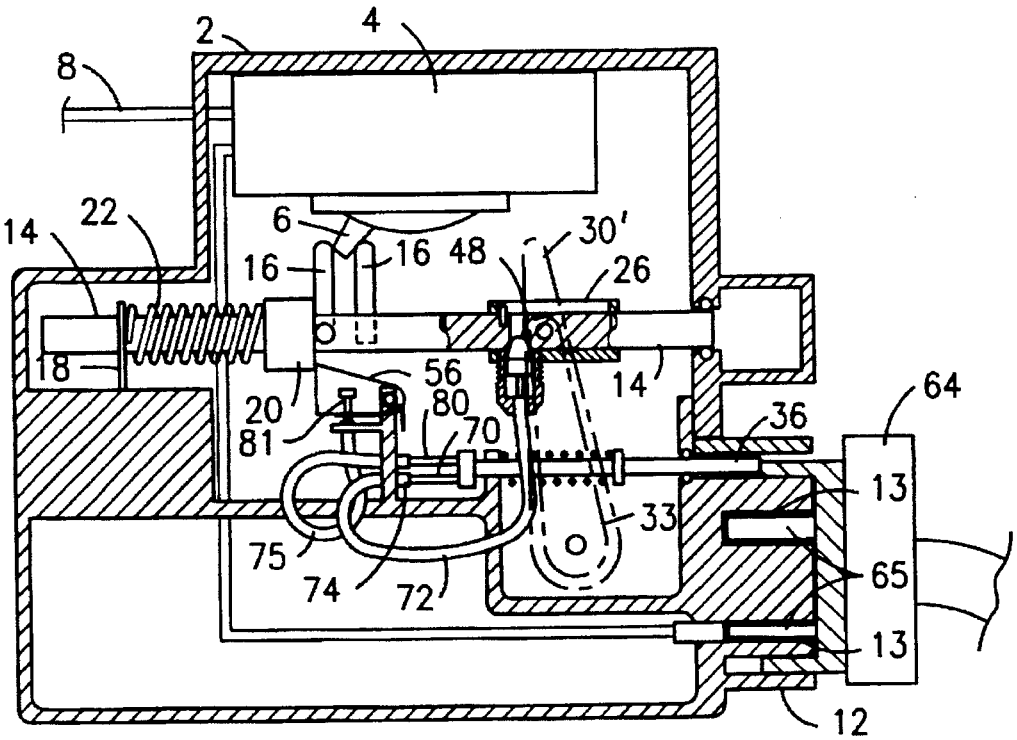

FIGS. 11 and 12 illustrate a structure generally similar to that of FIGS. 1 through 5 and 6 through 10, but with a different form of apparatus for moving the connecting member 48 and the latching member 56 into and out of engagement with the actuating member 14 and latching element 20. Specifically, in this embodiment, the plug engaging member 36 is connected to a first end 70 of a flexible cable that is slidably mounted within a flexible sheath 72, a structure also known as a Bowden Wire. A first end 74 of that sheath 72, proximal the first end of the cable 70, is mounted to said housing 2, with a second end 76 of that sheath being connected to the operating member 26, with the second end 78 of the cable carrying the connecting member 48 for reciprocating movement into and out of engagement with the actuating member when the plug 64 is moved respectively into and out of the plug inserted position, described above. The first end 80 of a corresponding second cable, carried within its sheath 79, is also connected to the plug engaging member 36 and, with the opposite end 81 connected to the latching member 56, effects positive pivoting movement of the latching member 56 into and out of a position interfering with movement of the latching element 20. Operation of this flexible cable variation of the toggle linkage structure previously described with respect to FIGS. 1 through 5 is substantially similar to the operation of that previously described structure. Likewise, the embodiment of FIG. 12 reflects the inclusion of such a flexible cable structure into the arcuately pivoting handle embodiment of FIGS. 6 through 10.

Figure 13:
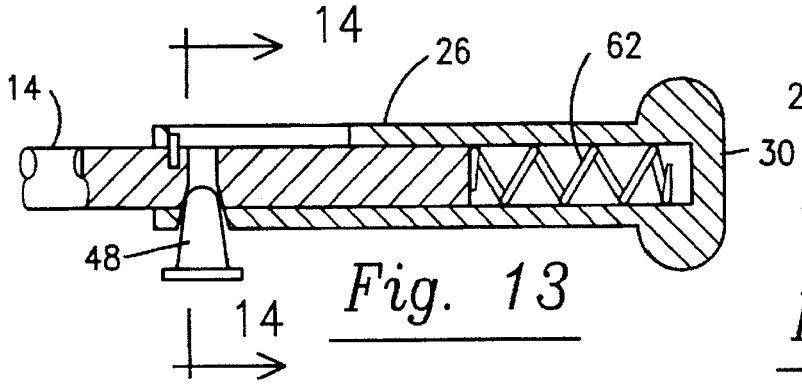
FIG. 13 illustrates a connecting mechanism for connecting the operating member and the actuating member of the apparatus of FIG. 1.
Figure 14:
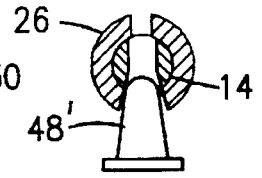
FIG. 14 is an end sectional view taken along lines 14—14 of FIG. 13.
Figure 15:
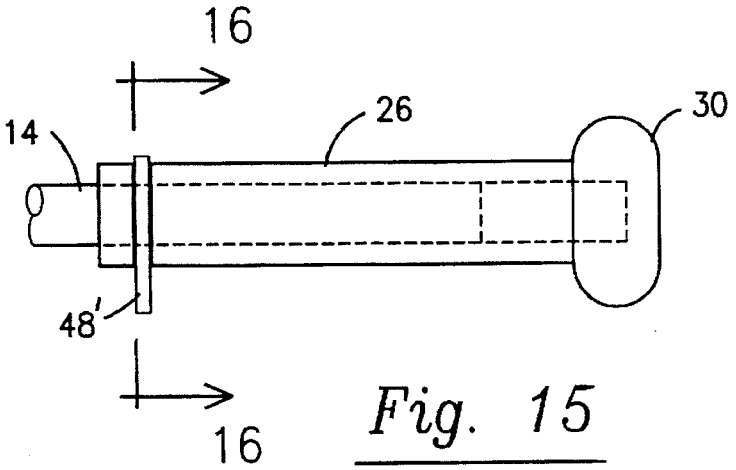
FIG. 15 illustrates an alternative embodiment of the mechanism of FIG. 13.
Figure 16:
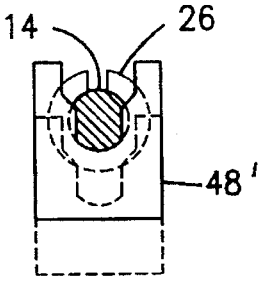
FIG. 16 is an end sectional view taken along lines 16—16 of FIG. 15.
Figure 17:
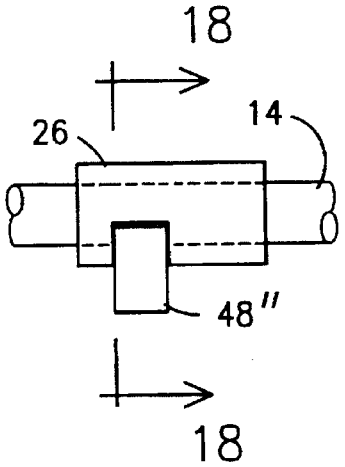
FIG. 17 represents yet another alternative embodiment of the mechanism for interconnecting the operating member and actuating member of the apparatus of this invention.
Figure 18:
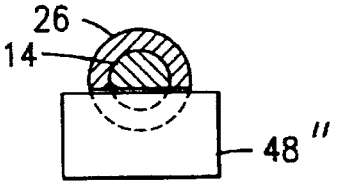
FIG. 18 is an end sectional view taken along lines 18—18 of FIG. 17.

FIGS. 13 through 19 illustrate various alternative configurations of the connecting mechanism for interconnecting the movement of the operating member 26 and the actuating member 14. The side sectional view of FIG. 13 and the end sectional view of FIG. 14 illustrate the cross bolt apparatus illustrated and described above with respect to FIGS. 1 through 12, in which a pin or bolt 48 is inserted through an aperture in the operating member 26 into a recess or aperture in the actuating member 14. FIGS. 15 and 16 illustrate an analogous structure in which a plate referred to as a "C" lock 48' is inserted through slots in the sides of the operating member 26 into corresponding grooves in the sides of the actuating member 14. FIGS. 17 and 18 illustrate another variation in which a generally rectangular detent 48" is movable in a generally vertical direction into and out of engagement with corresponding slots in the lower portion of operating member 26 and actuating member 14, for operation in a manner very analogous to that of the cross bolt mechanism of FIGS. 13 and 14.

Figure 19:
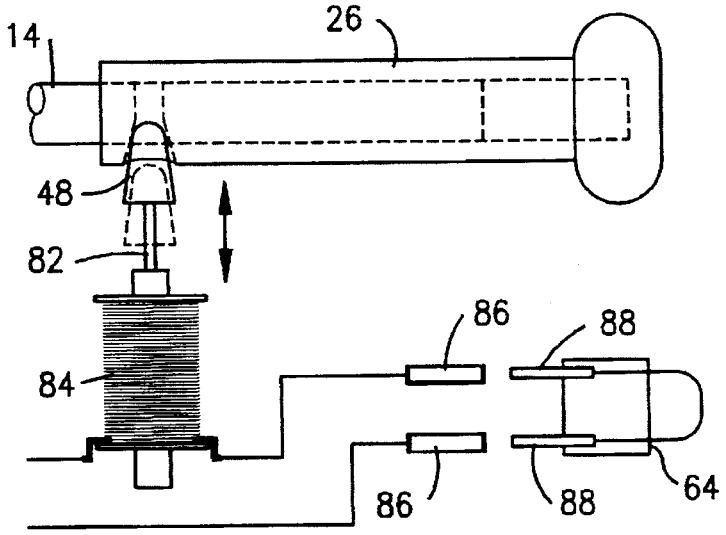
FIG. 19 is yet another alternative embodiment of the mechanism for interconnecting the operating member and actuating member of the apparatus of this invention utilizing an electrically powered solenoid.

FIG. 19 illustrates another variation in which the connecting member 48, similar to that of FIGS. 13 and 14, is mounted to a shaft 82 received through the center of an electrically powered solenoid 84 for reciprocal movement as shown by the solid and dashed lines in FIG. 19. The solenoid is connected to a source of electrical power through connectors 86 that engage elements 88 carried by the plug 64 to complete the circuit and energize the solenoid 84 only when the plug 64 is inserted into its receptacle. Thus, connecting engagement between the operating member 26 and the actuating member 14 is effected only when that circuit is completed and thus only when the plug 64 is inserted within the receptacle. This same solenoid, or an additional solenoid preferably also actuates and releases the latching mechanism described above. By the use of such electrically operated solenoids, remote operation of the entire unit may be provided to facilitate remote locking out of the unit or remote switching of the unit to the "off" position.

FIGS. 20 through 29 illustrate a second principal embodiment of the electrical switch and interlock apparatus of this invention. This embodiment is illustrated with a portion of the housing cover removed for clarity of illustration. This apparatus includes a housing 102, which may conveniently be fabricated of a suitable metal and to which are mounted one or more circuit breakers 104, each having a switch handle 106, shown in the side view of FIG. 21, which may be moved between a first position illustrated in FIG. 21, in which the circuit within the breaker is open, and a second position, illustrated in FIG. 28, in which the switch handle 106 is moved to a second, circuit completing position. As with the embodiment of FIGS. 1–5, the circuit breaker includes an input power cable, not shown, connected through the circuit breaker to an output cable, not shown, which is connected to the plug receptacle 108. In the illustration of FIGS. 20 through 24 there is no plug inserted into the receptacle 108.

Mounted within the housing 102 is the circuit breaker actuating member 110, which may conveniently be machined of a suitable low friction synthetic resin, such as nylon or polyethylene. This actuating member 110 is mounted for sliding movement on operating member 112, which may suitably comprise a circular rod or tubular member supported by a bushing 114 through the housing 102 and another bushing 116 that is mounted to the support tray 118.

Figure 21:
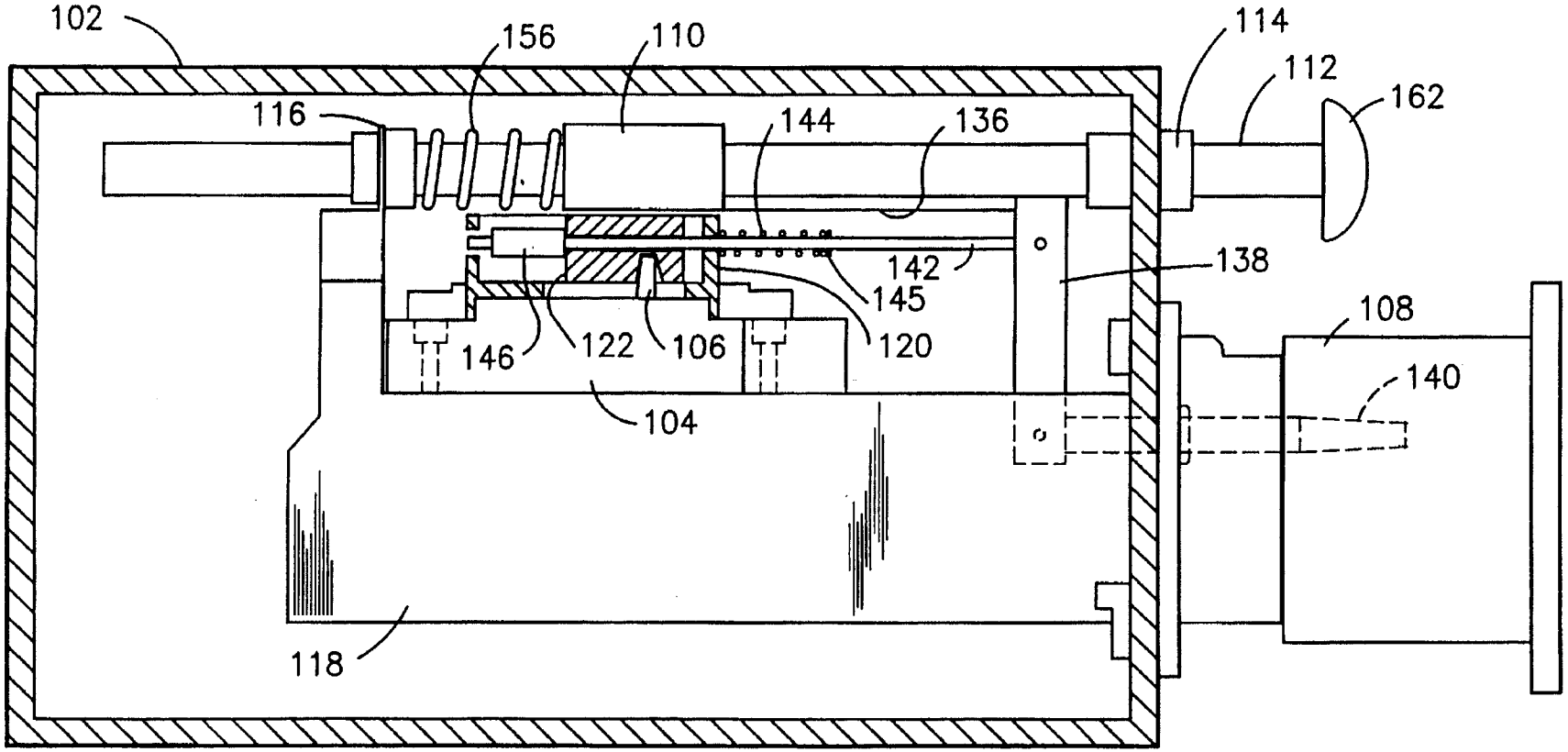
FIG. 21 is a side elevation, partially in section, of the apparatus of FIG. 18.
Figure 22:
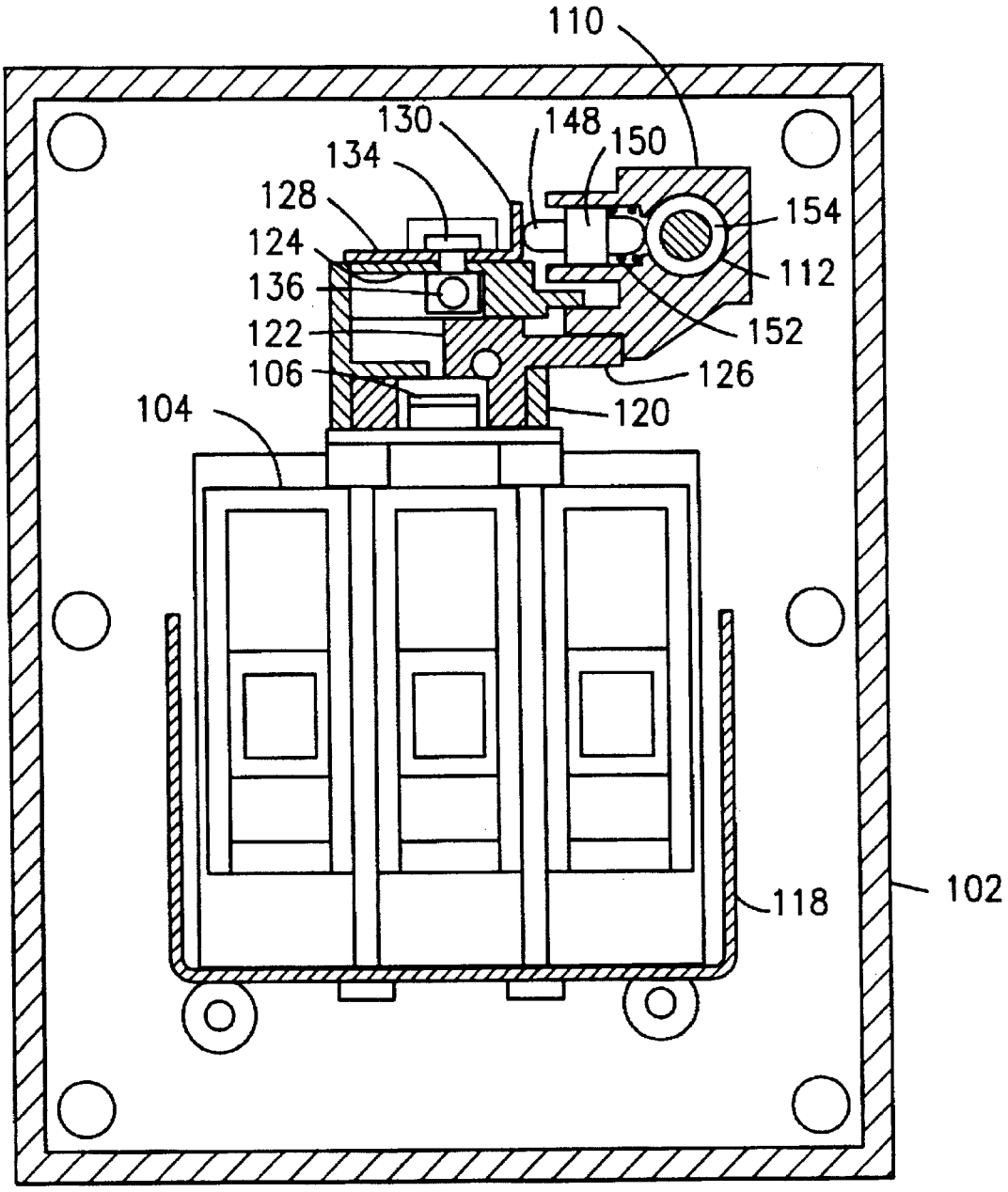
FIG. 22 is a sectional view taken along lines 22—22 of FIG. 20.

Mounted to the top of the circuit breaker is a toggle enclosure 120, suitably also fabricated of a synthetic resin, such as nylon or polyethylene. Mounted within that toggle enclosure 120 is a toggle retainer 122 that is capable of sliding longitudinally within the toggle enclosure between the positions illustrated in FIGS. 21, 24 and 26, to the right of those illustrations, and a second position, illustrated in FIG. 28, displaced to the left in that figure, or to the rear of the switch and interlock mechanism. This toggle retainer includes a slot that fits over the circuit breaker switch handle 106 to move that handle 106 as the toggle retainer 122 is moved. Fitting within the top of the toggle enclosure is a cover 124 that holds the toggle retainer 122 in place. As is indicated in FIG. 22, a portion 126 of the toggle retainer 122 extends outwardly and mates with a portion of the actuating member 110 in any suitable manner, such as by a tongue-and-groove arrangement or by pinning or by other conventional connections. Thus, the toggle retainer 122 will move in concert with the actuating member 110 and serves to operatively connect that actuating member 110 to the switch handle 106 of the circuit breaker 104.

Supported on top of the toggle enclosure cover for movement in a direction transverse to the longitudinal axis of the operating member 112 is a slide plate 128, which may conveniently be fabricated of either a rigid synthetic resin or a metal, such as stainless steel. The slide plate 128 includes a connecting member actuating portion 130 and a pair of camming surfaces 132 and 133 in the form of the opposite sides of a generally S-shaped slot within which rides a cam follower 134 in the form of a headed pin, which is affixed to extension rod 136. This extension rod 136 is affixed to the upper end of a riser bar 138, as shown in FIG. 21, to the lower end of which is attached a plug engaging rod 140. Also affixed to the riser bar 138 close to extension rod 136 is second extension rod 142 carrying a resilient biasing element, such as compression spring 144 and its retainer 145. The combination of the plug engaging element 140, riser bar 138 and extension rods 136 and 142 comprise, together, an assembly referred to as a plug engaging member reciprocally mounted to the plug receptacle 108 for reciprocal movement upon the insertion and removal of a plug into and from that receptacle 108. Adjacent the end of extension rod 142 opposite the end connected to riser 138 is a retainer member 146, which, in the configuration shown in FIGS. 20 and 21, engages the back end of the toggle retainer 122. This retainer 146, in conjunction with compression spring 144 connected to the extension rod 142 and bearing against the front end of the toggle enclosure 120, urges the toggle retainer 122 and the circuit breaker switch handle 106 to the forward, open circuit position illustrated in FIG. 21.

Figure 20:
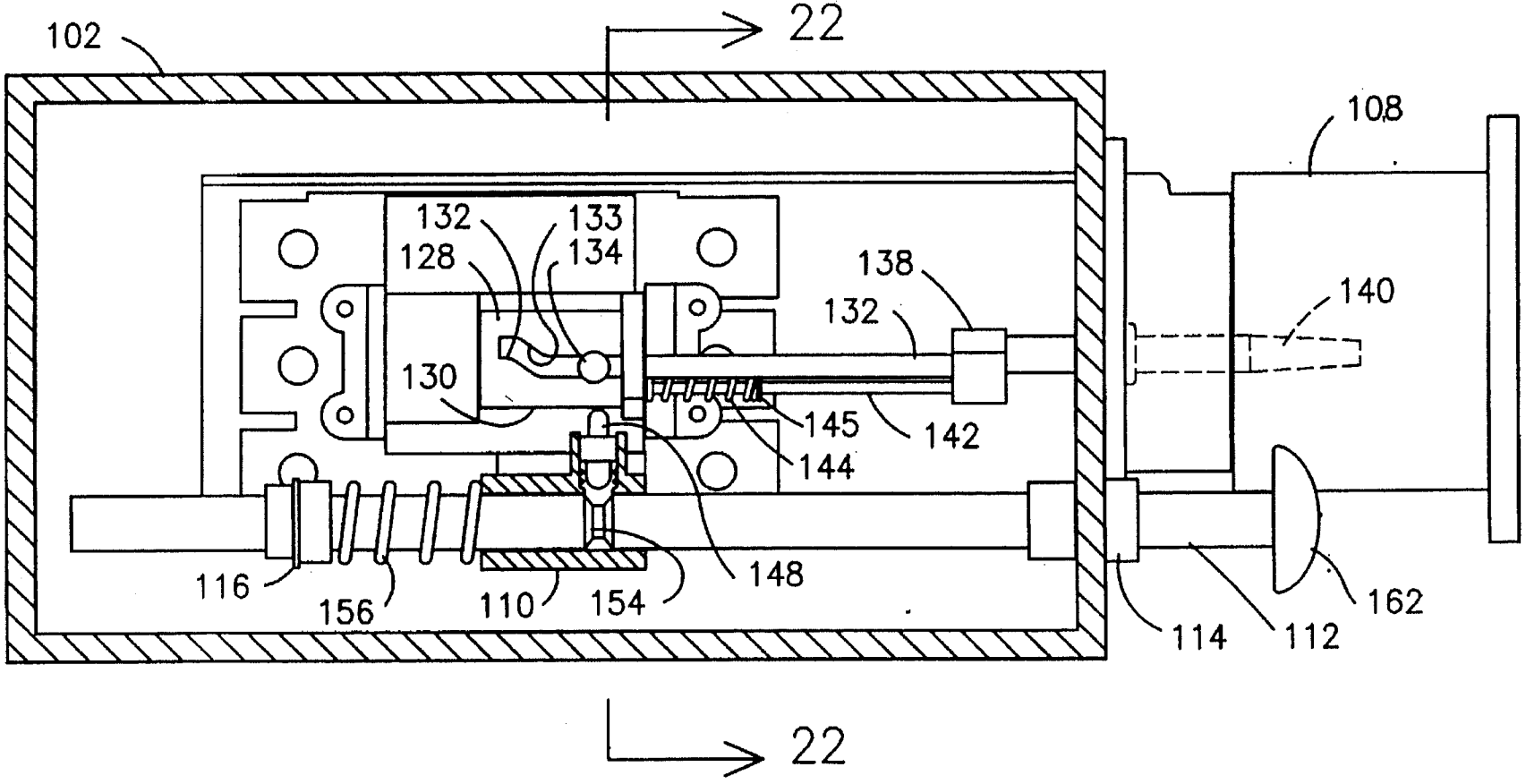
FIG. 20 is a top plan view, partially in section, of a second preferred embodiment of the electrical switch and interlock apparatus of the present invention, representing the apparatus when no plug is present in the receptacle and the circuit breaker is in the "off" position.

As shown most clearly in FIG. 22, the actuating member 110 has connected to it a connecting member 148 which may be slidably received through a sleeve 150 and resiliently biased by suitable means, such as a spring 152, toward a retracted position bearing against the shoulder 130 of slide plate 128 and out of engagement with operating member 112, as shown in FIGS. 20 and 22. As may be seen in FIG. 20, the operating member 112 is provided with a recess, suitably in the form of a circumferential groove 154, for purposes to be described below. As shown in FIGS. 20 and 21, when there is no plug inserted into the receptacle 108, the operating member 112 is free to move longitudinally of its axis, to the left and right in FIGS. 20 and 21, sliding within the actuating member 110 and effecting no movement thereof. In this configuration, with no resistance provided by the actuating member 110 or the circuit breakers 104, biasing means, such as a weak compression spring 156, will urge actuating member 110 to the position shown in FIGS. 20 and 21.

Figure 23:
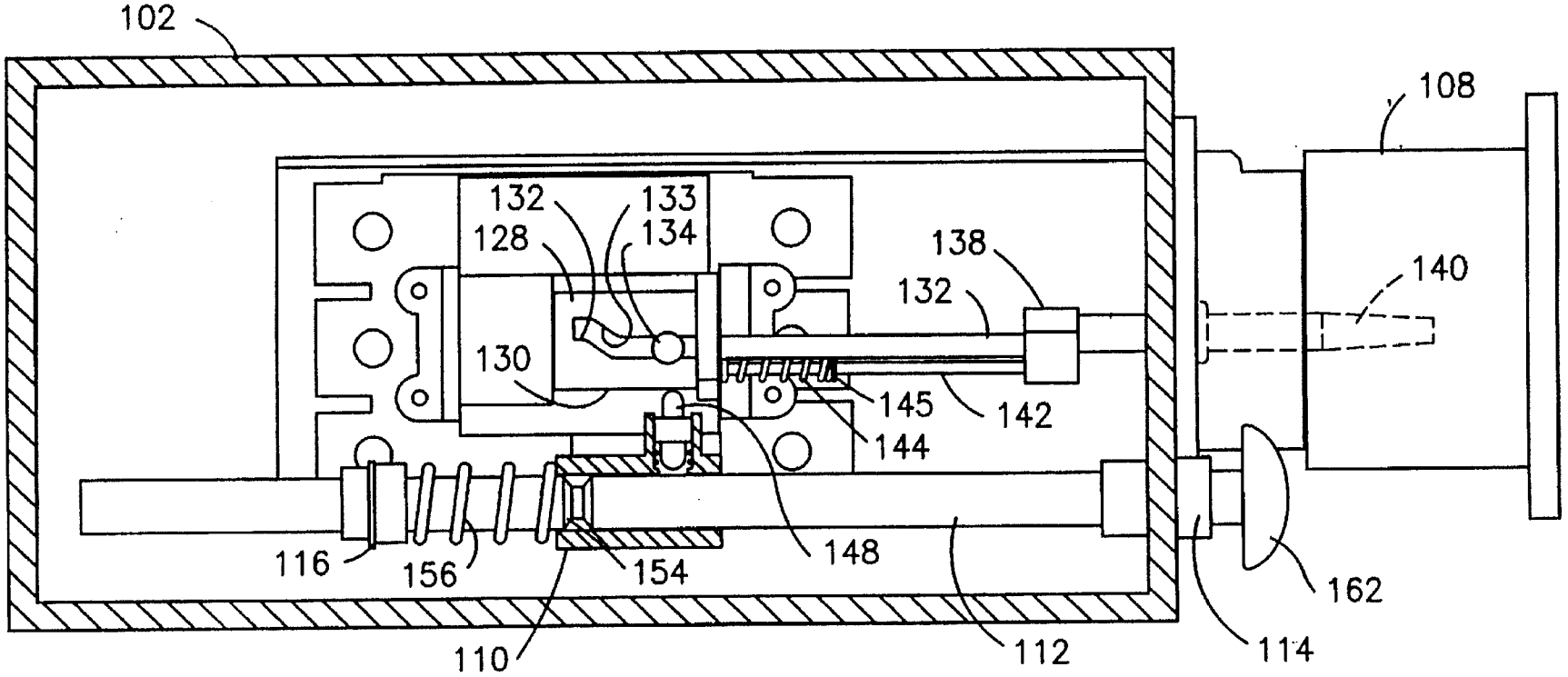
FIGS. 23 and 24 are, respectively, a top plan view and a side elevation of the apparatus of FIG. 1 with no plug present in the receptacle and an attempted reset of the circuit breaker with the circuit breaker remaining in the "off" position.
Figure 24:
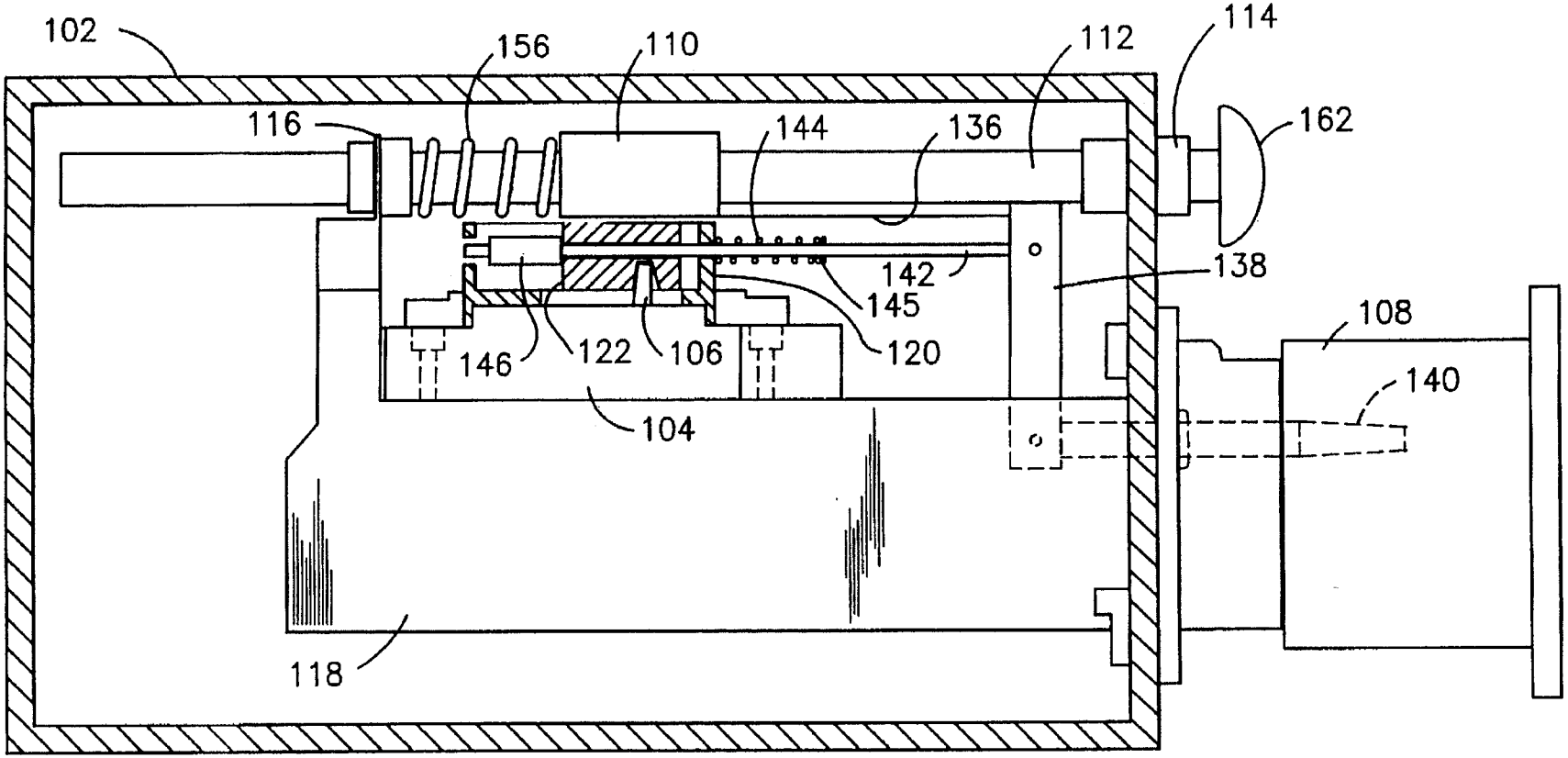

As shown in FIGS. 23 and 24, when there is no plug inserted into the receptacle 108, so that the plug engaging element 140 and the other elements 136, 138 and 142 remain urged to the right of these illustrations by the biasing means 144, there is no operative connection between the operating member 112 and the actuating member 110 to effect any joint or corresponding movement of the two, so that operating member 112 may simply slide in a reciprocating manner freely within the bore of actuating member 110. Thus, if a user attempts to reset the circuit breaker, to move the switch handle 106 from the first, open circuit position to a second, circuit completing position, there will be no connecting engagement between the operating member 112 and the actuating member 110 and its associated toggle retainer 122 to move the switch handle 106. Accordingly, all that will occur is movement of the actuating member 112, with the circuit breaker remaining in the open circuit position as shown in FIG. 24.

Figure 25:
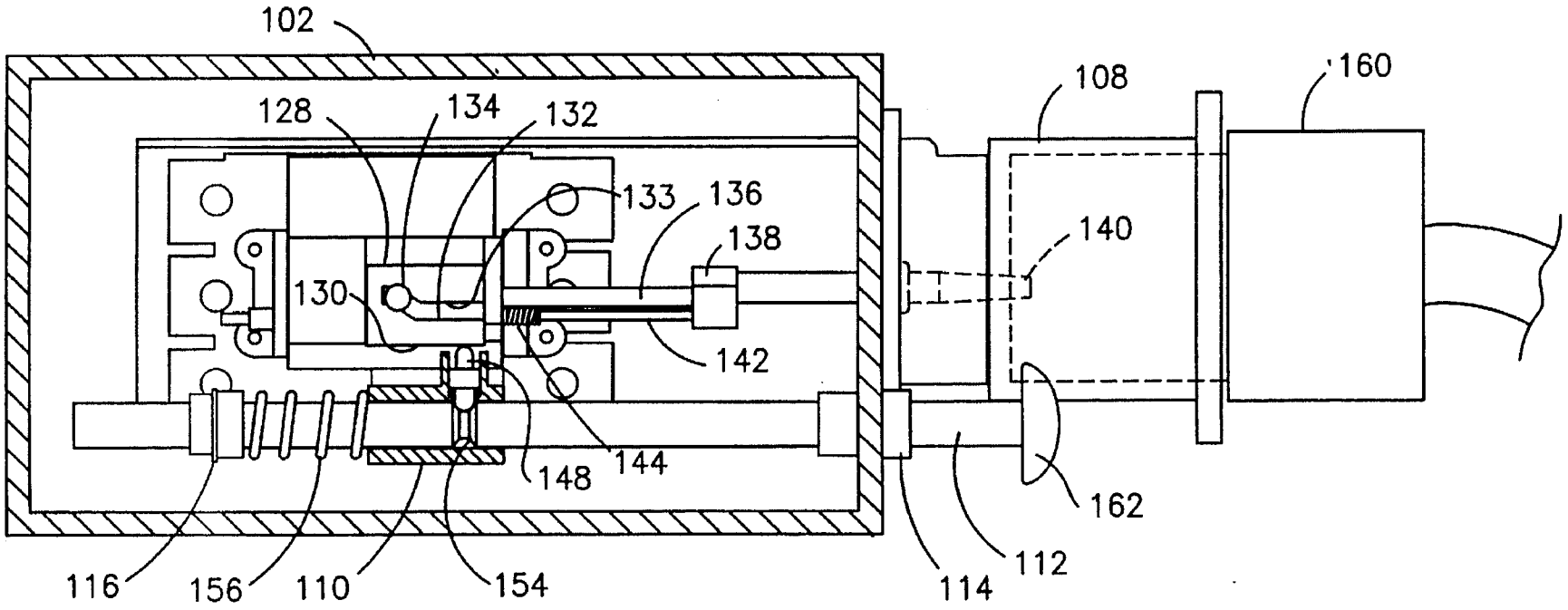
FIGS. 25 and 26 are, respectively, a top plan view and a side elevation of the apparatus of FIG. 13 with a plug inserted and the circuit breaker in the normal "off" position.
Figure 26:
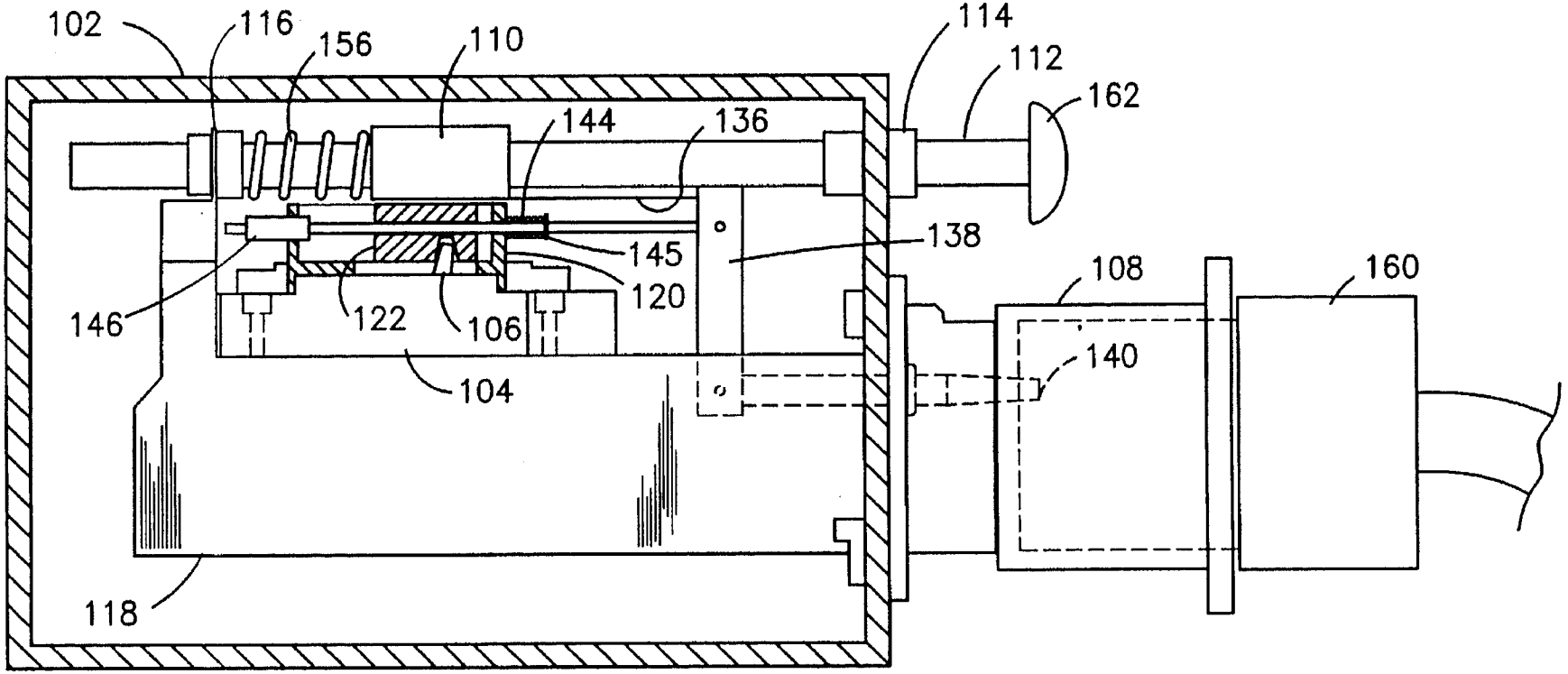

When a plug 160, such as a Mipco plug connecting a refrigerating system power cable to the power supply controlled by the apparatus of this invention, or any other conventional plug is inserted into the plug receptacle 108, it engages the plug engaging member 140 and moves it to the left, as shown in FIGS. 25 and 26. This urges the remainder of the components of the plug engaging member assembly likewise to the left in these illustrations and moves the pin 134, which serves as a cam follower, along the camming surface 132, thus driving the slide plate 128 in the direction toward the actuating member 110. The movement of the actuating portion 130 of slide plate 128 in this direction thus drives the connecting member 148 in the same direction, urging it into connecting engagement with the recess 154 of the operating member 112. In this configuration the actuating member 110 and the operating member 112 are connected together for corresponding, joint, movement, which in this embodiment will thus be coaxial movement of the two members along the longitudinal axis of the operating member 112. In the configuration illustrated in FIGS. 25 and 26 the circuit breaker remains off but is now ready to be reset.

Figure 27:
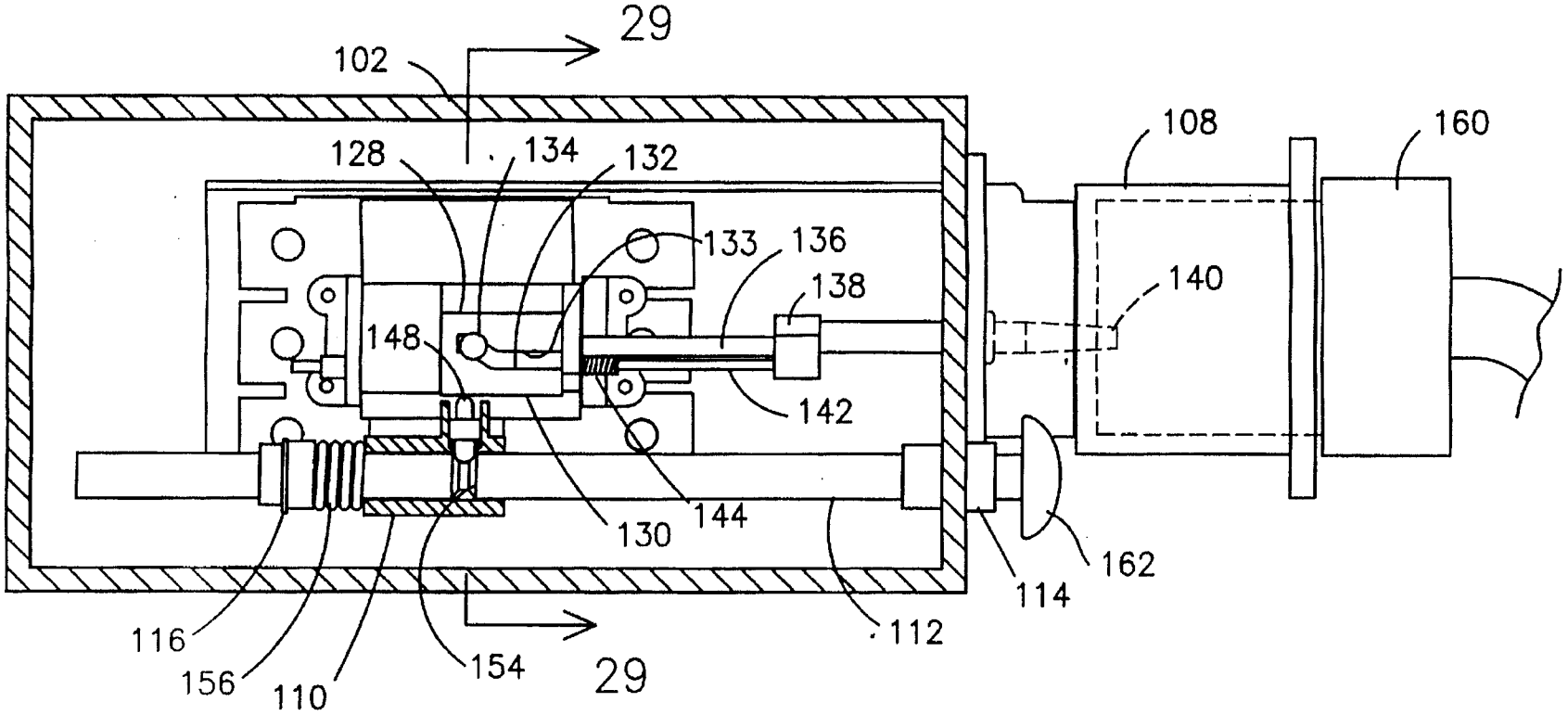
FIGS. 27 and 28 are, respectively, a top plan view and a side elevation, partially in section, of the apparatus of FIG. 13 with a plug inserted into the receptacle with the operating member moving the circuit breaker to the circuit completing "on" position.
Figure 28:
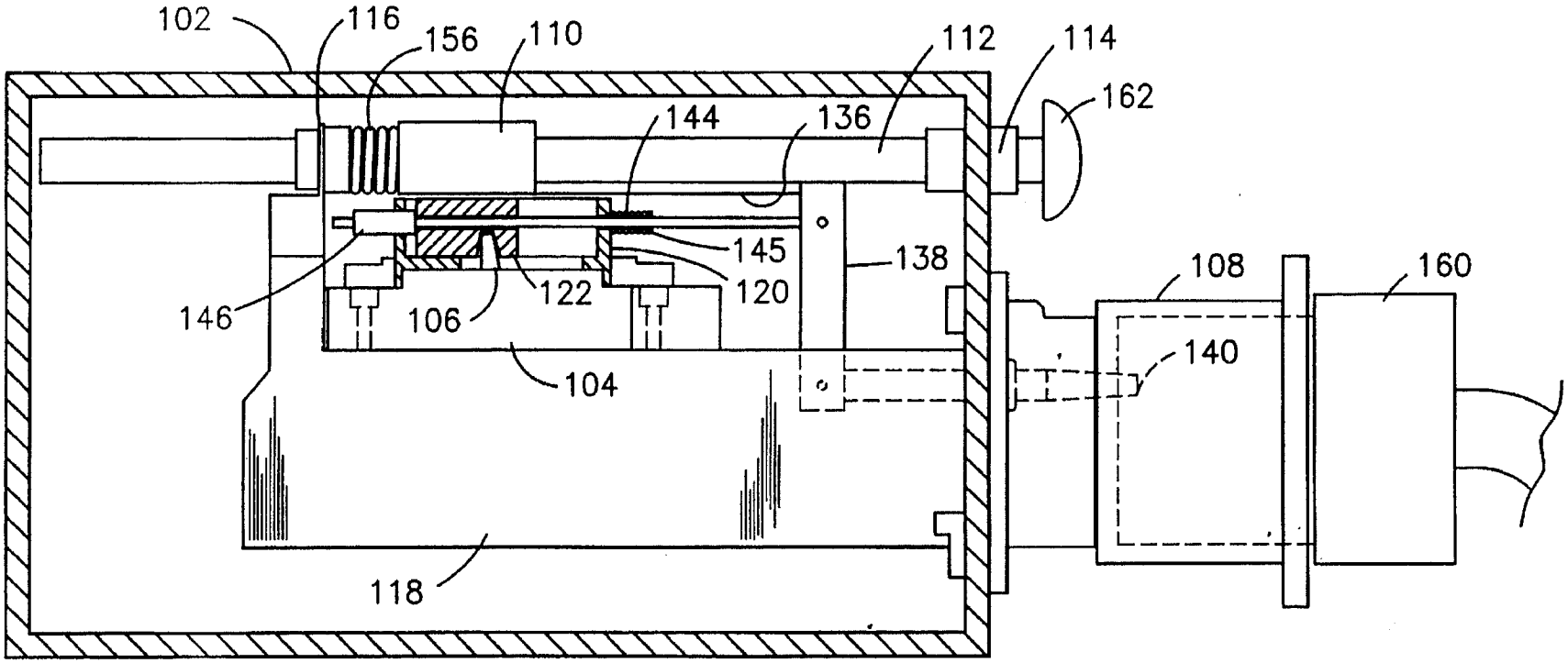
Figure 29:
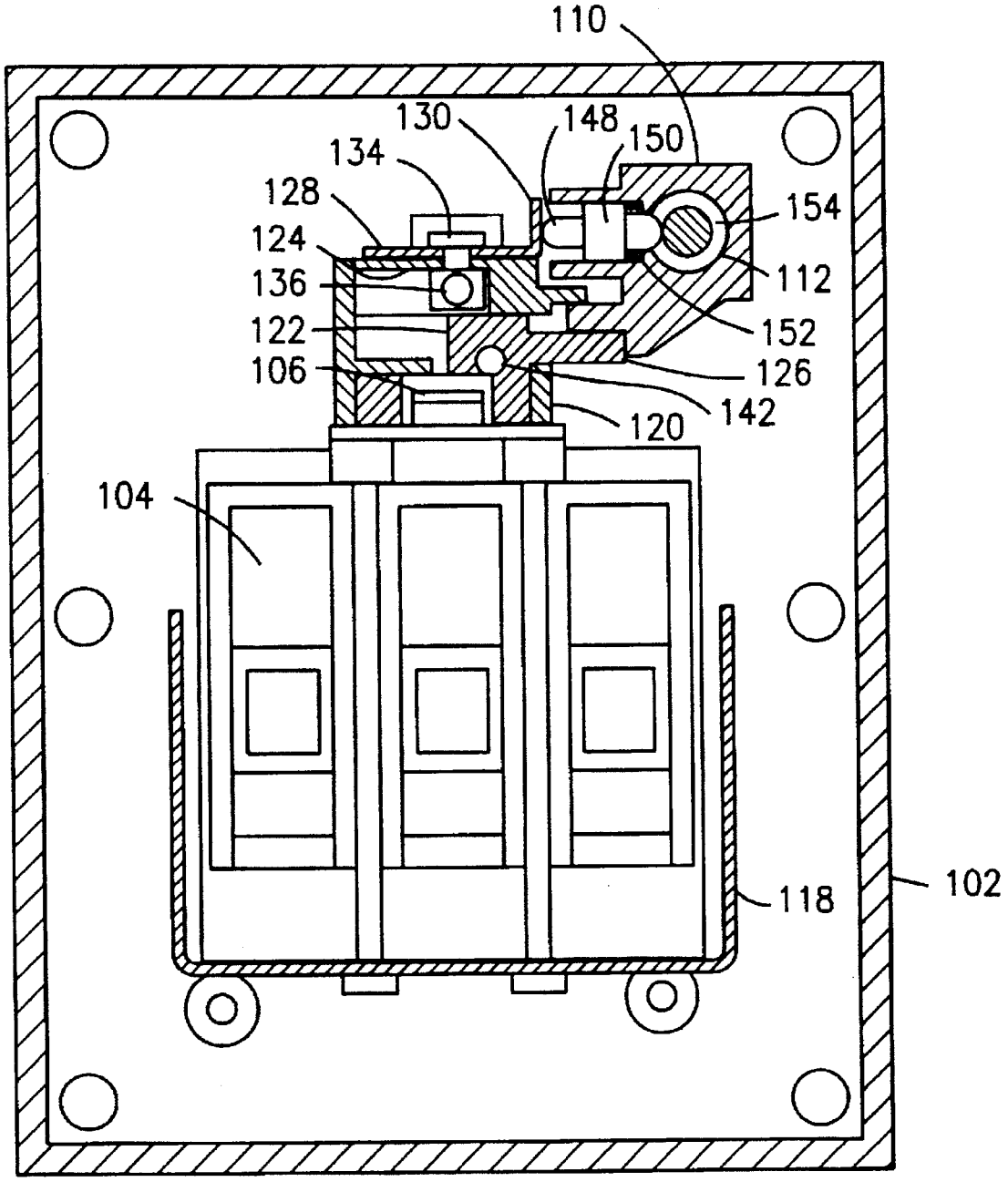
FIG. 29 is a end sectional view taken along lines 29—29 of FIG. 27.

In FIGS. 27 and 28 are illustrated the results of a human operator resetting or turning on the circuit breaker of this apparatus by pushing the handle 162 of the operating member 112 inwardly of the housing, to the left in FIGS. 28 and 29. Because the operating member 112 and the actuating member 110 are operatively connected together by their mutual engagement with the connecting member 148, the actuating member 110 and its connected toggle retainer 122 are moved to the left, thus moving the circuit breaker switch handle 106 likewise to the left, to the second, circuit completing state. The spring 156 that is compressed by movement of the actuating member 110 is selected to be sufficiently weak not to trip the circuit breaker switch handle 106 after it has been set but only to urge the actuating member 110 gently forward along the operating member 112 when there is no engagement between the operating member 112 and the actuating member 110.

If, after a plug 160 has been inserted into this apparatus and the circuit breaker 104 has been turned on, the operator desires to turn off the power without removing the plug 160, he may do so by simply pulling the handle 162 on the operating member 112 outwardly of the unit, as shown in FIGS. 25 and 26. The operative connection between the operating member 112 and the actuating member 110 effected by the engagement of those two members with the connecting member 148 will thus move the actuating member 110 and its connected toggle retainer 122 to the right in these figures, causing the toggle retainer to move the switch handle 106 back to the first, open circuit position, as shown in FIGS. 25 and 26. So long as the plug 160 remains inserted, the operator can again turn on the power by again pushing in on the handle 160 to move the apparatus back to the configuration illustrated in FIGS. 27 and 28.

If the plug 160 were to be removed without first turning off the power by pulling the handle 162 outwardly of the unit, in the manner shown in FIGS. 25 and 26, the result would be exactly the same as is shown in FIGS. 20 and 21. Removal of the plug 160 would allow the spring 144 on the extension rod 142 to move that rod 142 and its connected extension rod 136 back to the right, as shown in FIGS. 20 and 21. This movement would cause the cam following pin 134 to move back along the second camming surface 133 to the position shown in FIG. 20, retracting the slide plate 128 and its actuating portion 130 away from the actuating member 110 and permitting the resilient biasing spring 152 to urge the connecting member 148 out of engagement with the recess and operating member 112, so that the actuating member 110 may then move freely longitudinally of the operating member 112. At that same time the resilient biasing means in the form of compression spring 144 that moves the extension rod 142 to the right in FIGS. 20 and 21 will also move the retainer 146 in the same direction, thus driving the toggle retainer 122 also to the right, thereby moving the switch handle 106 back to its first position with the circuit breaker in the open circuit state. The biasing spring 156, acting against an E-clip or pin through the operating member 112 adjacent the back side of actuating member 110, will also urge the operating member 112 to the right, thus moving its handle 162 outwardly of the front of the unit. By this manner of operation the switch unit, such as the circuit breaker will always be released to the "off" position when a plug is removed, even if an operator attempts to defeat this safety feature by holding the handle 162 in while removing the plug. As described with respect to the previous embodiments, the plug or connector engaging member 140 is dimensioned such that connection between the connecting member 148 and operating member 112 and actuating member 110 cannot engage and thus connect operating member 112 and actuating member 110 unless the plug or second connector portion 160 has been sufficiently received by the receptacle or first inlet portion 108 to complete an electrical connection between the electrical connecting means carried within.

Figure 30:
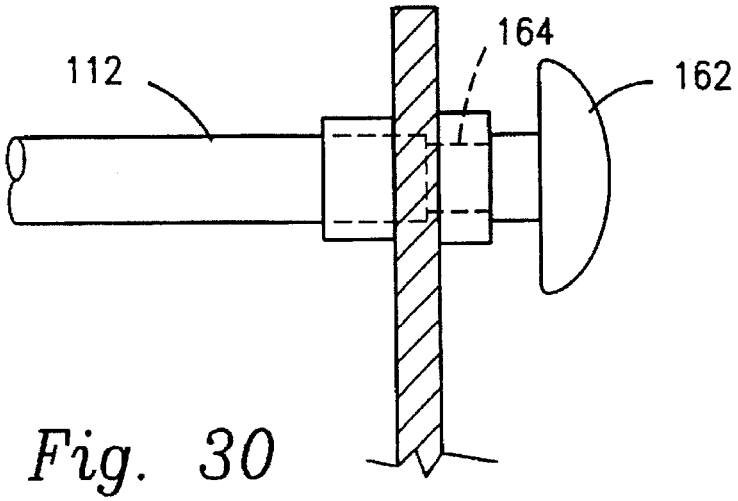
FIGS. 30 through 32 illustrate a structure for use with the operating member of this invention to indicate if the circuit breaker is on, tripped, or off.
Figure 31:
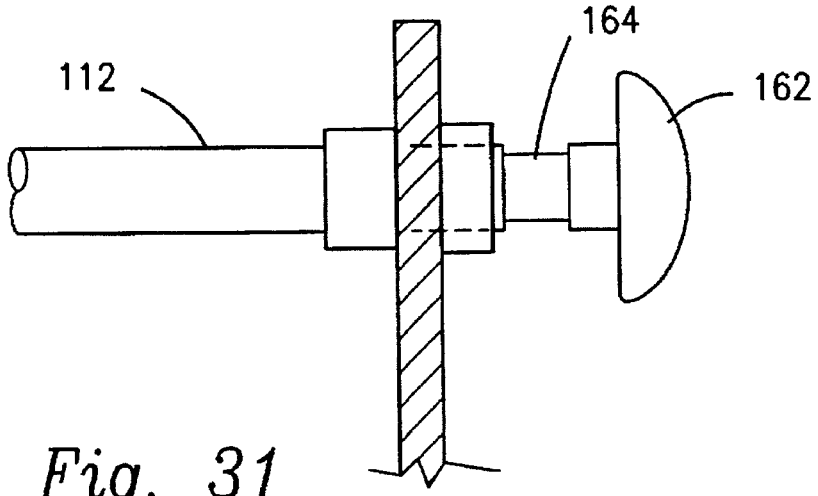
Figure 32:
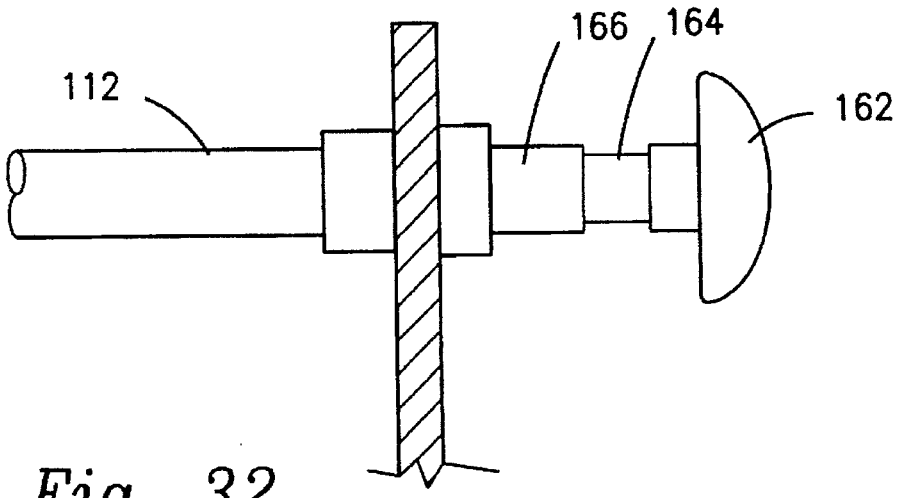

FIGS. 30 through 32 illustrate a convenient manner of providing an external indication of the position of the circuit breaker within this apparatus, whether the breaker be in the "on" circuit completing state, in a tripped state in which the circuit breaker has automatically disconnected its power upon sensing an overload situation, or in the full "off" position in the open circuit state. Suitably, a band or patch 164 of visually contrasting material, such as a bright paint or the like, may be provided on the actuating member 112 at a predetermined position. This position would be such that, when a plug is inserted into the receptacle and the circuit breaker is moved to its "on" circuit completing state, the visual indication 164 would be hidden within the waterproofing bushing on the housing 102 through which the actuating member 112 extends. If the circuit breaker is tripped, but not moved to the full "off" position, that movement of the circuit breaker would urge the operating member 112 partially outwardly of the unit, to expose the visually contrasting portion immediately adjacent the waterproofing bushing through which the operating member 112 extends. When the circuit breaker has been moved to the full "off", open circuit position, either by removal of the plug from the receptacle or by an operator affirmatively moving the circuit breaker to the "off" position, that visually contrasting portion 164 on the operating member 112 would be spaced sufficiently outwardly of the bushing through which the operating member 112 extends to provide a second visually different portion 166 between that portion 164 and the bushing. Thus, by simple inspection of the appearance and position of the visually significant portion 164, an operator can readily determine the state of the circuit breaker within the unit. While this additional feature has been described with respect to the second embodiment of the apparatus of this invention, it would obviously apply equally to all of the other embodiments utilizing the linear operating member 112.

In FIG. 33 is illustrated a switch and connector interlock system substantially similar to that of FIG. 1 but in which circuit breaker 4 has been replaced by a rotary switch 170. A rack portion 172 is attached to the actuating member 14 to rotate the pinion between a "on" and a "off" position in a manner exactly analogous to the operation described with respect to the embodiment of FIG.1. However, in this embodiment, the switch 170 is a conventional switch without the protective features of a circuit breaker, such as described above.

In FIG. 33 also is illustrated a connector structure in which the first connector portion 176 is a conventional male-type inlet instead of the receptacle shown with the previous embodiments. Accordingly, the second connector portion 178, attached to the electrical cable, is a conventional female connector, instead of the plug illustrated with respect to the previous embodiments. Because either the plug/receptacle combination or the inlet/connector combination may be used with equal facility the term "first connector portion" is used to denote the portion of either combination that is attached to the housing with the term "second connector portion" referring to either the plug or the connector, attached to the electrical cable.

In FIG. 34 is illustrated yet an additional embodiment of this apparatus in which the circuit breaker 4 has been replaced by a pivoting rotary switch 180, in which a handle 182 functions in a manner exactly analogous to the switch handle 6 of the embodiment of FIG. 1. As with FIG. 33, this switch unit 180 is suitably a conventional on-off switch without the protective features of the circuit breaker illustrated in FIGS. 1 through 29. In other respects the apparatus of FIG. 34 operates in a manner exactly analogous to that described with respect to the embodiment of FIGS. 1 through 10.

While the foregoing discloses particularly preferred embodiments of the apparatus of this invention, it is to be understood that the disclosure is indicative only of the principles of the invention and is not to be considered limitative thereof. Because numerous variations and modifications of the apparatus of this invention, all within the scope of this invention, will readily occur to those skilled in the art, the scope of the invention is to be determined solely by the claims appended hereto.

What is claimed is:

1. An electrical switch comprising a housing;

a switch unit for selectively completing or breaking an electrical circuit, said unit being mounted within said housing and adapted to be connected to a source of electrical power;

a first connector portion mounted to said housing and electrically connected to said switch unit and being adapted to receive a second connector portion mounted to an electrical cable, said first and second connector portions each including electrical connecting means for selectively completing an electrical connection between said first connector portion and said second connector portion when said second connector portion is received by said first connector portion and for breaking said electrical connection when said second connector portion is removed from said first connector portion;

a switch unit operating member being mounted to said housing for movement between a first position and a second position, said operating member including a handle for enabling a human operator to move said operating member between said positions;

an actuating member mounted for movement corresponding to said movement of said operating member between said first position and said second position and being operatively connected to said switch unit for moving a portion of said switch unit between a first, open circuit state when said actuating member is in said first position and a second, circuit completing state when said actuating member is in said second position, said actuating member being resiliently biased toward said first position and further comprising means for selectively engaging said operating member for movement therewith;

a connector portion engaging member mounted to said first connector portion for reciprocal movement in a predetermined direction by said reception of said second connector portion by said first connector portion, said connector portion engaging member being operatively connected to said actuating member for effecting said selective engagement between said operating member and said actuating member when said connector portion engaging member is moved in said predetermined direction and after said completion of said electrical connection between said first connector portion and said second connector portion, and for releasing said selective engagement when said plug engaging member is moved in a direction opposite said predetermined direction but prior to said breaking of said electrical connection between said first connector portion and said second connector portion, whereby the switch unit resilient biasing means will move the switch unit to the open circuit state when the connector portion engaging member is moved in the opposite direction, regardless of the position of the switch unit operating member, whereby the second connector portion cannot be received by or removed from the first connector portion with the switch unit in a circuit completing state; and resilient biasing means urging said connector portion engaging member to move in said opposite direction upon removal of said second connector portion from said first connector portion.

2. The electrical switch of claim 1 wherein said actuating member selective engaging means further comprises a connecting member selectively movable between a first position engaging both said operating member and said actuating member and a second position out of said engagement with at least one of said operating member or said actuating member, and means for selectively moving said connecting member into said first position when said connector portion engaging member is moved to said connector portion received position and for releasing said connecting member from said first position when said connector portion engaging member is moved from said connector portion received position, whereby reception of a second connector portion by the first connector portion effects the connecting engagement between the operating member and the actuating member.

3. The electrical switch of claim 2 wherein said means for urging said connecting member comprises a toggle linkage connected to said connector portion engaging member for moving said connecting member toward said operating member upon reception of said second connector portion by said first connector portion and away from said operating member upon removal of said second connector portion from said reception by said first connector portion.

4. The electrical switch of claim 3 further comprising a latching element carried by said actuating member for latching engagement with said toggle linkage a latching member connected to said toggle linkage for movement between a retracted position spaced away from engagement with said latching element, when said connector portion engaging member is moved from said connector portion received position, and an extended position for engagement with said latching element when said connector portion is in said connector portion received position, whereby, when a second connector portion is received by the first connector portion and the switch unit operating member and the actuating member are actuated to move the switch unit portion to the circuit completing state, the latching member is moved into a position where it will engage the latching element and hold the actuating member in that position.

5. The electrical switch of claim 4 wherein said latching member is resiliently biased toward said actuating member and said latching element such that, when said toggle linkage and said latching member are in said extended position, said latching element can be moved past said latching member as said actuating member is moved in a first direction from said switch unit open circuit state to said circuit completing state, but said latching element is releasably latched against movement in a second direction opposite said first direction, whereby the switch unit will remain in the circuit completing state unless the connected operating member and actuating member are moved to the open circuit state by a human operator.

6. The electrical switch of claim 5 wherein said latching element is slidably received between limiting elements on said actuating member and is resiliently biased to urge said actuating member toward said switch unit open circuit state, whereby the latching member will urge the actuating member to the open circuit state except when the latching member is engaged by said latching element.

7. The electrical switch of claim 2 wherein said selectively urging means includes a first flexible cable slidably mounted within a flexible sheath for reciprocating movement relative to said sheath, said sheath having a first end mounted to said housing and a second end mounted to said operating member with a first end of said cable being connected to said connector portion engaging member and a second end carrying said connecting member for reciprocating movement into and out of engagement with said actuating member when said second connector portion is moved respectively into and out of said connector portion received position with respect to said first connector portion.

8. The electrical switch of claim 7 further comprising a latching element carried by said actuating member, a latching member mounted for pivotal movement between a retracted position spaced away from engagement with said latching element and an extended position for engagement with said latching element, and a second flexible cable slidably mounted within a flexible sheath for reciprocating movement relative to said sheath, said cable having a first end connected to said connector portion engaging member for reciprocating movement therewith and a second end connected to said latching member to move said latching member to said retracted position when no second connector portion is received by said first connector portion and to said extended position when a second connector portion is so received by said first connector portion, and said sheath having a first end proximal said cable first end and connected to said housing and having a second end proximal said cable second end and also connected to said housing.

9. The electrical switch of claim 2 wherein said connecting member comprises a pin insertable through an aperture in said operating member and into a receiver in said actuating member.

10. The electrical switch of claim 2 wherein said connecting member comprises a cross-bar member insertable through a slot in said operating member into a receiver in said actuating member.

11. The electrical switch of claim 2 wherein said means for urging said connecting member comprises a solenoid attached to said connecting member and electrically connected to said connector portion engaging member, such that reception of said second connector portion by said first connector closes an electrical circuit energizing said solenoid and provides for said solenoid to urge said connecting member toward said operating member.

12. The electrical switch of claim 2 wherein said connecting member moving means comprises a cam following element connected to said plug engaging member and engaging a first camming surface of a slide member that is operatively connected to said connecting member, such that said movement of said connector portion engaging member to said connector portion inserted position moves said cam following element along said slide member first camming surface and moves said connecting member into said first position in connecting engagement with said operating member and said actuating member, whereby, when the connecting member is in the first position, movement of the operating member in the predetermined direction will effect movement of the actuating member in the same direction.

13. The electrical switch of claim 12 wherein said slide member includes a second camming surface generally complementary to said first camming surface such that movement of said connector portion engaging member from said connector portion received position to a connector portion removed position moves said cam following element along said slide member second camming surface moving said slide member away from said operating member and said actuating member and permitting withdrawal of said connecting member from engagement with one of said actuating member and said operating member under said urging of said connector portion engaging member biasing means, whereby the connecting member will be withdrawn from engagement with at least one of the actuating means or the operating means upon removal of a second connector portion from reception by the first connector portion.

14. The electrical switch of claim 13 wherein said connecting member comprises a spring-biased detent member.

15. The electrical switch of claim 12 further comprising resilient biasing means urging said connecting member toward said second position out of engagement with at least one of said operating member or said actuating member.

16. The electrical switch of claim 15 wherein said actuating member includes an aperture through which said connecting member extends, and said operating member includes a recessed portion into which said connecting member extends when in said first position, whereby the extension of the connecting member through the actuating member aperture and into the operating member recessed portion serves to effect the connecting engagement between the operating member and the actuating member.

17. The electrical switch of claim 16 wherein said operating member comprises a rod having a generally circular cross section, and said operating member recessed portion comprises a circumferential groove around said rod at a predetermined location along said rod.

18. The electrical switch of claim 1 wherein said operating member has a longitudinal axis and is mounted to said housing for reciprocating movement along said axis.

19. The electrical switch of claim 18 wherein said actuating member is mounted within said housing for movement coaxially with said operating member.

20. The electrical switch of claim 19 wherein said operating member comprises a rod having a circular cross section, and said actuating member comprises a member received onto said operating member rod for coaxial movement therewith.

21. The electrical switch of claim 1 wherein said operating member comprises an elongated member extending through at least one side of said housing and including a visual signalling portion that is visible outside said housing when said switch unit is in said open circuit state and is hidden by said housing when said switch unit is in said circuit completing state.

22. The electrical switch of claim 21 wherein said switch unit is a circuit breaker and wherein said visual signalling portion is visible outside said housing when said circuit breaker is in a tripped position.

23. The electrical switch of claim 1 wherein said operating member comprises an elongated member extending through at least one side of said housing, and said handle comprises a member attached to the end of said elongated member that extends outside said housing.

24. The electrical switch of claim 1 wherein said handle comprises an external member mounted to said housing and external thereto for pivoting movement about a shaft extending into said housing, and an internal arm mounted within said housing, with a first end of said arm being attached to said shaft for pivoting movement therewith and an opposed second end connected to said operating member for moving said operating member along said operating member axis as said external member is moved, whereby pivoting movement of the external member by a human operator will move the operating member along its axis.

* * * * *